US012209786B2

(12) United States Patent
Nuss et al.

(10) Patent No.: US 12,209,786 B2
(45) Date of Patent: Jan. 28, 2025

(54) REFRIGERATOR AND ICE-MAKING ASSEMBLY HAVING A REMOVABLE WATER BASIN

(71) Applicant: Haier US Appliance Solutions, Inc., Wilmington, DE (US)

(72) Inventors: Bart Andrew Nuss, Fisherville, KY (US); Brent Alden Junge, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 99 days.

(21) Appl. No.: 18/158,139

(22) Filed: Jan. 23, 2023

(65) Prior Publication Data

US 2024/0247855 A1 Jul. 25, 2024

(51) Int. Cl.
*F25C 1/25* (2018.01)
*F25C 1/24* (2018.01)

(52) U.S. Cl.
CPC ..... *F25C 1/25* (2018.01); *F25C 1/24* (2013.01); *F25C 2400/10* (2013.01); *F25C 2700/04* (2013.01)

(58) Field of Classification Search
CPC ..... F25C 1/25; F25C 1/24; F25C 2400/10; F25C 2400/04
See application file for complete search history.

(56) References Cited

U.S. PATENT DOCUMENTS 6,453,696 B1 9/2002 Kawasumi et al.
6,484,530 B1 11/2002 Hibino et al.
6,502,416 B2 1/2003 Kawasumi et al.
8,418,497 B2 4/2013 Lee et al.
8,567,210 B2 10/2013 Park et al.
9,074,802 B2 7/2015 Culley et al.
10,323,874 B2 6/2019 Mitchell
10,352,610 B2 7/2019 Miller et al.
10,605,512 B2 3/2020 Culley et al.
10,801,768 B2 10/2020 Junge et al.
11,009,281 B1 5/2021 Kridel et al.
11,035,602 B2 6/2021 Bertolini et al.
2018/0164029 A1* 6/2018 Lindel ..... F25D 23/067
2020/0041186 A1* 2/2020 Junge ..... F25C 1/25
2022/0107127 A1 4/2022 Mitchell et al.
(Continued)

FOREIGN PATENT DOCUMENTS

CA 2254590 C 8/2002
CN 101691978 B 6/2011
CN 102138047 A 7/2011
(Continued)

*Primary Examiner* — Elizabeth J Martin
(74) *Attorney, Agent, or Firm* — Dority & Manning, P.A.

(57) ABSTRACT

A refrigerator appliance includes a cabinet, a liner attached to the cabinet, a conductive ice mold, a water dispenser, and a water basin. The liner defines an icebox (IB) compartment. The conductive ice mold is mounted within the IB compartment. The conductive ice mold defines a mold cavity. The water dispenser is positioned below the conductive ice mold to direct an ice-building spray of water to the mold cavity. The water basin is removably disposed within the IB compartment below the conductive ice mold. The water basin includes a basin wall defining a water reservoir and an electrical basin plug fixed to the basin wall to move therewith.

20 Claims, 13 Drawing Sheets

(56) References Cited

U.S. PATENT DOCUMENTS

2022/0146174 A1 5/2022 Ryu et al.

FOREIGN PATENT DOCUMENTS

| | | | |
|---|---|---|---|
| CN | 103968613 | A | 8/2014 |
| CN | 110186230 | A | 8/2019 |
| CN | 110864468 | A | 3/2020 |
| WO | WO2008077775 | A1 | 7/2008 |

* cited by examiner

θR

REFRIGERATOR AND ICE-MAKING ASSEMBLY HAVING A REMOVABLE WATER BASIN

FIELD OF THE INVENTION

The present subject matter relates generally to refrigerator appliances, and more particularly to refrigerator appliances having a clear ice-making assembly.

BACKGROUND OF THE INVENTION

In domestic and commercial applications, ice is often formed as solid cubes, such as crescent cubes or generally rectangular blocks. The shape of such cubes is often dictated by the container holding water during a freezing process. For instance, an ice maker can receive liquid water, and such liquid water can freeze within the ice maker to form ice cubes. In particular, certain ice makers include a freezing mold that defines a plurality of cavities. The plurality of cavities can be filled with liquid water that stays static within the cavities and can freeze within the plurality of cavities to form solid ice cubes. Typical solid cubes or blocks may be relatively small in order to accommodate a large number of uses, such as temporary cold storage and rapid cooling of liquids in a wide range of sizes.

Although the typical solid cubes or blocks may be useful in a variety of circumstances, they have certain drawbacks. For instance, such typical cubes or blocks are fairly cloudy due to impurities found within the freezing mold or water. As a result, certain consumers find clear ice preferable to cloudy ice. In clear ice formation processes, dissolved solids typically found within water (e.g., tap water) are separated out and essentially pure water freezes to form the clear ice. Since the water in clear ice is purer than that found in typical cloudy ice, clear ice is less likely to affect drink flavors.

Additionally or alternatively, typical cubes or blocks may have a size or shape that is undesirable in certain conditions. There are certain conditions in which distinct or unique ice shapes may be desirable. Specifically, relatively large or rounded ice billets or gems (e.g., around two inches in diameter) will melt slower than typical ice sizes/shapes. Slow melting of ice may be especially desirable in certain liquors or cocktails. Moreover, such billets or gems may provide a unique or upscale impression for the user.

In recent years, ice making appliances have been developed for forming relatively large ice billets in a manner that avoids trapping impurities and gases within the billet. These appliances also use precise temperature control to avoid a dull or cloudy finish that may form on the exterior surfaces of an ice billet (e.g., during rapid freezing of the ice cube). Nonetheless, such systems have generally been very bulky and unfeasible for incorporation into a commercial refrigerator appliance. In particular, the inefficiency and large mass of these dedicated appliances have made them unsuitable for use within an appliance that also stores food items (e.g., within a fresh food chamber or freezer chamber). Moreover, mounting an icemaker or ice-making assembly within the same chamber as one or more food items risks imparting undesirable flavors or require subjecting ice to temperatures better suited for storing food items. Additionally or alternatively, water status or storage for water to be frozen as ice billets may become important, for example, to ensure consistent results, yet any storage area may need to be accessed or cleaned regularly Accordingly, further improvements in the field of ice making and refrigerator appliances would be desirable. In particular, it may be desirable to provide a refrigerator appliance capable of reliably and efficiently producing substantially clear ice billets (e.g., outside of a chamber for storing food) while ensuring various components are easily accessed or cleaned.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet, a liner attached to the cabinet, a conductive ice mold, a water dispenser, and a water basin. The liner may define an icebox (IB) compartment. The conductive ice mold may be mounted within the IB compartment. The conductive ice mold may define a mold cavity. The water dispenser may be positioned below the conductive ice mold to direct an ice-building spray of water to the mold cavity. The water basin may be removably disposed within the IB compartment below the conductive ice mold. The water basin may include a basin wall defining a water reservoir and an electrical basin plug fixed to the basin wall to move therewith.

In another exemplary aspect of the present disclosure, a refrigerator appliance is provided. The refrigerator appliance may include a cabinet, a liner attached to the cabinet, a thermodynamic assembly, a conductive ice mold, a water dispenser, and a water basin. The liner may define an icebox (IB) compartment. The thermodynamic assembly may be mounted within the cabinet outside of the IB compartment. The thermodynamic assembly may include a chilled air supply duct and a chilled air return duct defining at least a portion of an air path to circulate a chilled airflow. The conductive ice mold may be mounted within the IB compartment. The conductive ice mold may define a mold cavity along the air path to receive the chilled airflow from the chilled air supply duct. The water dispenser may be positioned below the conductive ice mold to direct an ice-building spray of water to the mold cavity. The water basin may be slidably disposed within the IB compartment below the conductive ice mold. The water basin may include a basin wall defining a water reservoir and an electrical basin plug fixed to the basin wall to move therewith.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
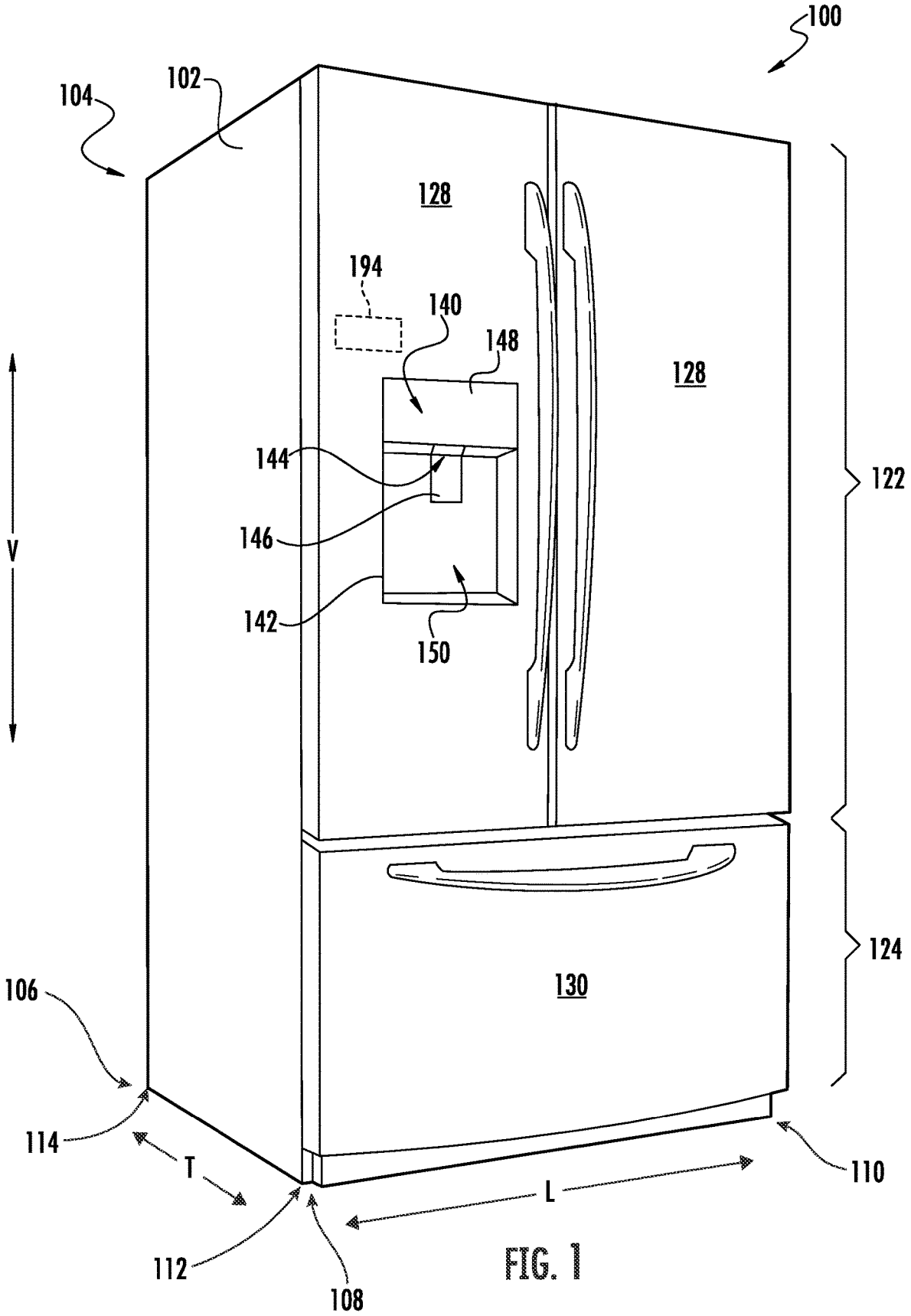
FIG. 1 provides a perspective view of a refrigerator appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

In some aspects of the present disclosure, a refrigerator is provided and includes an ice-making assembly that is generally configured to make clear ice billets or cubes. The ice-making assembly may include a water reservoir that can be mounted in and easily removed from a chilled chamber of the refrigerator (e.g., within a fresh food compartment, freezer compartment, or compartment defined within a door of the refrigerator).

Figure 2:
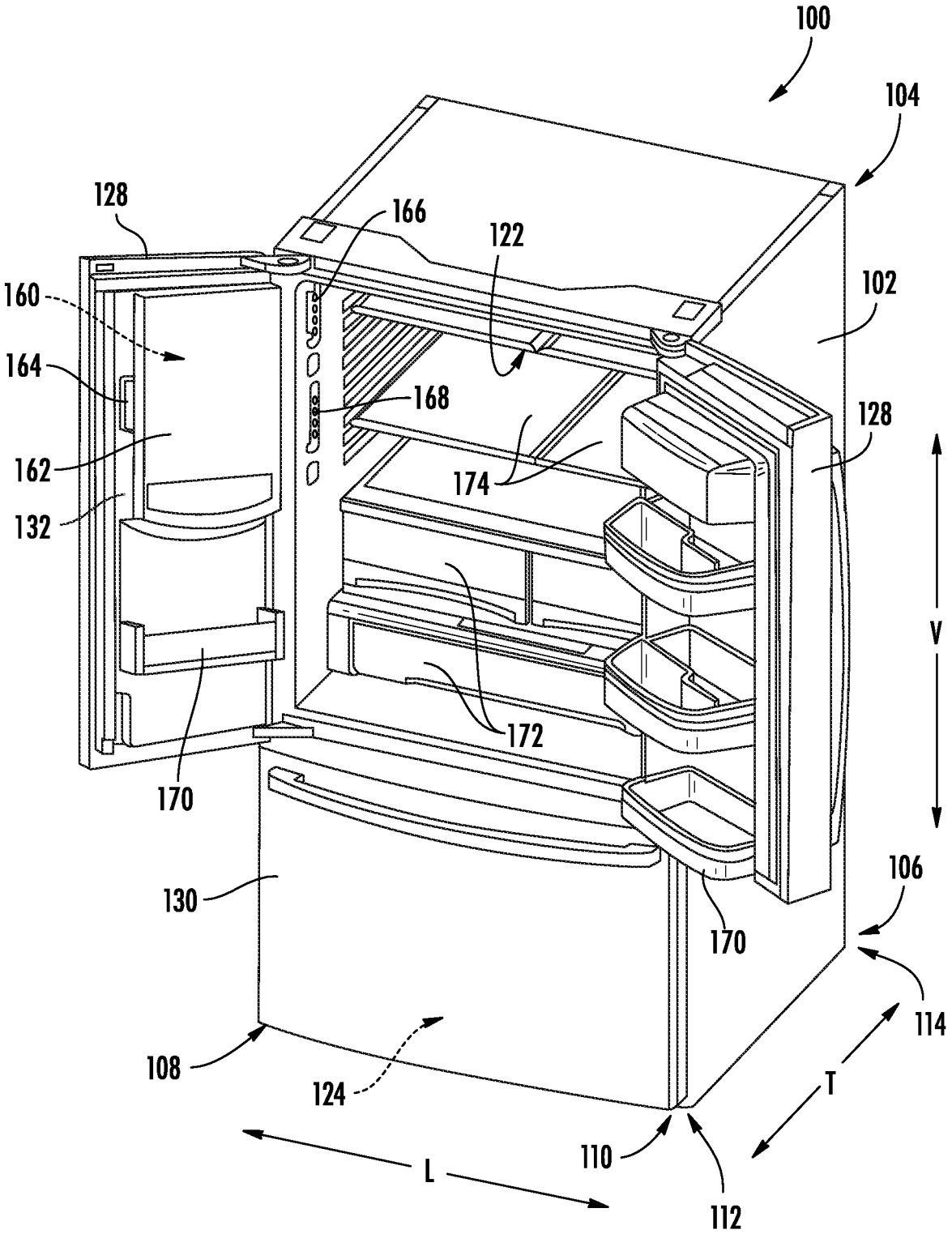
FIG. 2 provides a front view of the exemplary refrigerator appliance of FIG. 1 with the refrigerator doors shown in an open position.

Turning to the figures, FIGS. 1 and 2 illustrate a perspective view of a refrigerator 100. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

According to the illustrated embodiment, various storage components are mounted within fresh food chamber 122 to facilitate storage of food items therein as will be understood by those skilled in the art. In particular, the storage components include bins 170, drawers 172, and shelves 174 that are mounted within fresh food chamber 122. Bins 170, drawers 172, and shelves 174 are positioned to receive of food items (e.g., beverages or solid food items) and may assist with organizing such food items. As an example, drawers 172 can receive fresh food items (e.g., vegetables, fruits, or cheeses) and increase the useful life of such fresh food items.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

Refrigerator appliance 100 also includes a delivery assembly 140 for delivering or dispensing liquid water. Delivery assembly 140 includes a dispenser 142 positioned on or mounted to an exterior portion of refrigerator appliance 100, e.g., on one of refrigerator doors 128. Dispenser 142 includes a dispenser outlet 144 for accessing liquid water. An actuating mechanism 146, shown as a paddle, is mounted below dispenser outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A control panel 148 is provided for controlling the mode of operation. For example, control panel 148 includes a plurality of user inputs (not labeled), such as a water dispensing button.

Dispenser outlet 144 and actuating mechanism 146 are an external part of dispenser 142 and are mounted in a dispenser recess 150. Dispenser recess 150 is positioned at a predetermined elevation convenient for a user to access water and enabling the user to access water without the need to bend-over and without the need to open refrigerator doors 128. In the exemplary embodiment, dispenser recess 150 is positioned at a level that approximates the chest level of a user.

FIG. 2 provides a perspective view of a door 128 of refrigerator appliance 100 shown with refrigerator doors 128 in the open position. As shown, a liner 132 that is attached (e.g., directly or indirectly) to cabinet 102 may define a sub-compartment, such as an icebox (IB) compartment 160 for holding an icemaker or ice-making assembly. For example, at least one door 128 may include a door liner 132 defining icebox compartment 160. In such embodiments, icebox compartment 160 extends into fresh food chamber 122 when refrigerator door 128 is in the closed position. Although icebox compartment 160 is shown in door 128, additional or alterative embodiments may include an icebox compartment 160 defined within door 130 or apart from any door (e.g., directly attached to and fixed within cabinet 102). As discussed in greater detail below, an icemaker or ice-making assembly 300 may be positioned or disposed within icebox compartment 160.

An access door—e.g., icebox door 162—may be hinged to icebox compartment 160 to selectively cover or permit access to opening of icebox compartment 160. Icebox door 162 permits selective access to icebox compartment 160. Any manner of suitable latch 164 is provided with icebox compartment 160 to maintain icebox door 162 in a closed position. As an example, latch 164 may be actuated by a consumer in order to open icebox door 162 for providing access into icebox compartment 160. Icebox door 162 can also assist with insulating icebox compartment 160 (e.g., by thermally isolating or insulating icebox compartment 160 from fresh food chamber 122). Generally, this thermal insulation helps maintain icebox compartment 160 at a temperature below the freezing point of water.

In addition, icebox compartment 160 may receive cooling air from a chilled air supply duct 166 and a chilled air return duct 168 disposed on a side portion of housing 102 of refrigerator appliance 100. In this manner, the supply duct 166 and return duct 168 may recirculate chilled air from a suitable thermodynamic assembly 180 (see FIG. 3) through icebox compartment 160. As will be described in greater detail below, during certain operations, chilled air (e.g., from evaporator 188 and chilled air supply duct 166) may flow to ice-making assembly 300 (e.g., as motivated by an air handler or fan 192) and may assist ice formation by ice-making assembly 300.

Figure 3:
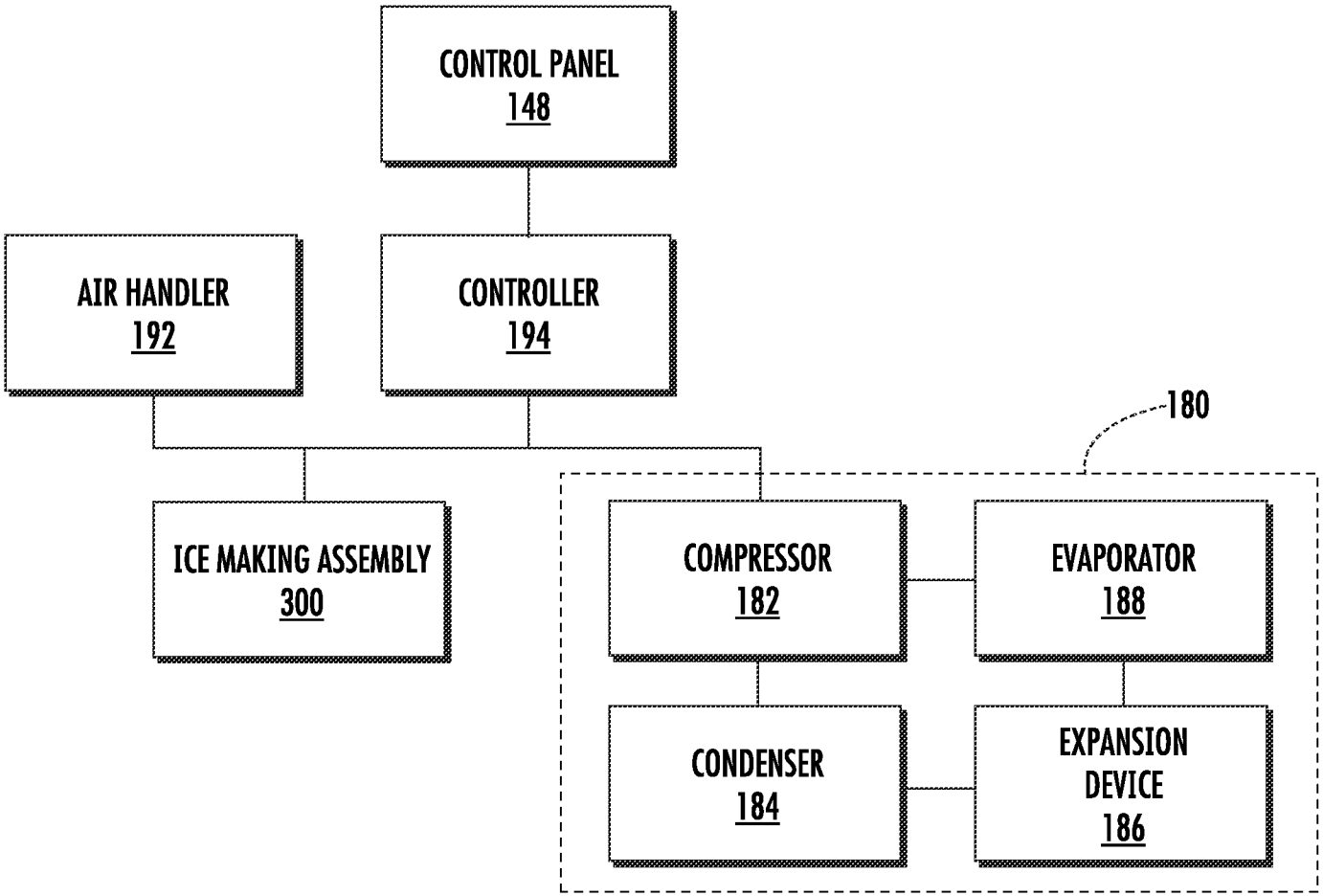
FIG. 3 provides a schematic view of various components of the exemplary refrigerator appliance shown in FIG. 1.
Figure 4:
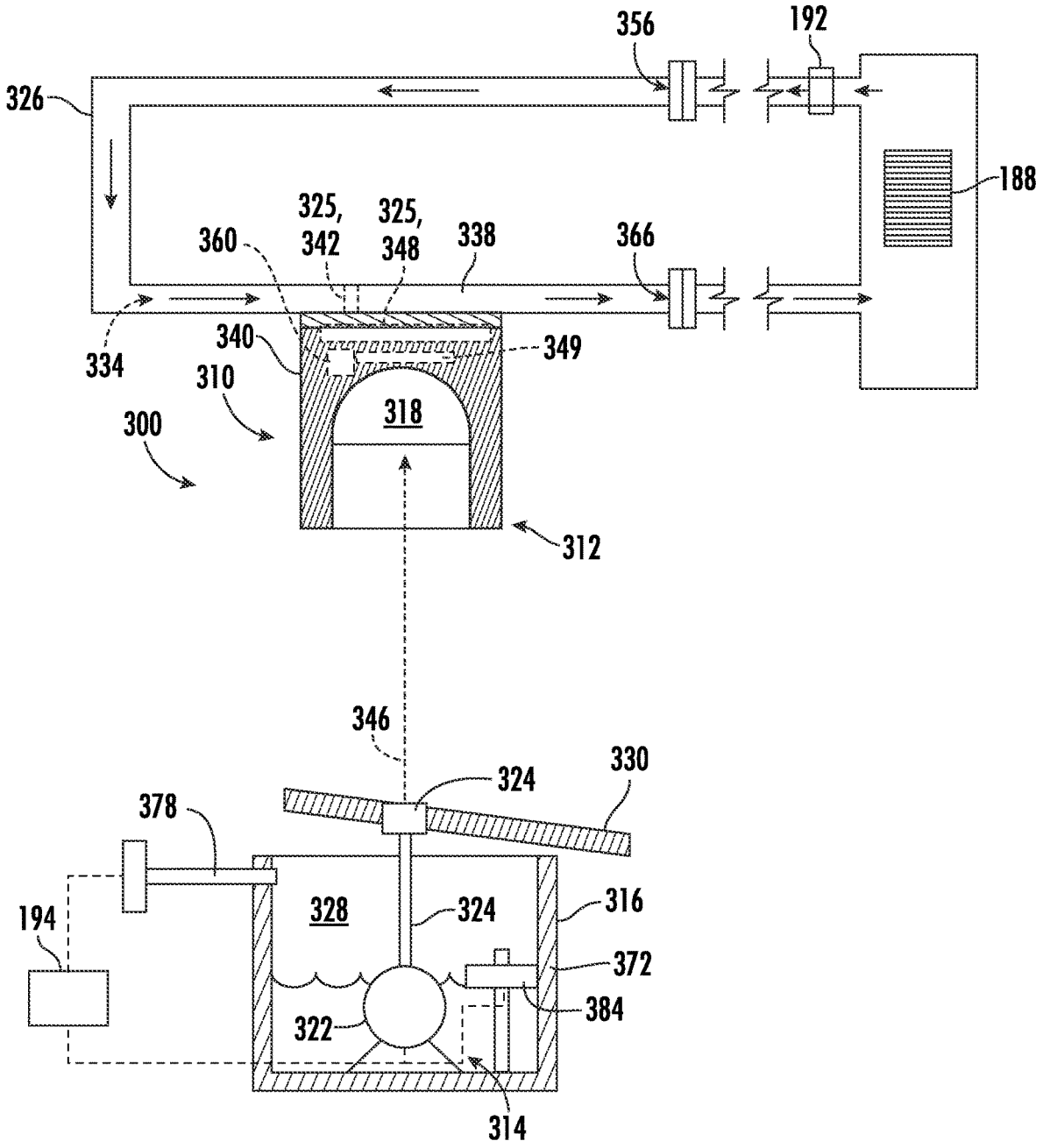
FIG. 4 provides a schematic view of an ice-making assembly according to exemplary embodiments of the present disclosure.

FIG. 3 provides a schematic view of certain components of refrigerator appliance 100. As may be seen in FIG. 3, refrigerator appliance 100 includes a thermodynamic assembly 180 for cooling air within refrigerator appliance 100 (e.g., within fresh food chamber 122, freezer chamber 124, or icebox compartment 160). In some embodiments, thermodynamic assembly 180 includes a sealed cooling system for executing a vapor compression cycle. The sealed cooling system may include, for instance, a compressor 182, a condenser 184, an expansion device 186, and an evaporator 188 connected in fluid series and charged with a refrigerant. As will be understood by those skilled in the art, the sealed cooling system may include additional components (e.g., at least one additional evaporator, compressor, expansion device, or condenser). As an example, thermodynamic assembly 180 may include two evaporators.

Within the sealed cooling system, gaseous refrigerant flows into compressor 182, which operates to increase the pressure of the refrigerant. This compression of the refrigerant raises its temperature, which is lowered by passing the gaseous refrigerant through condenser 184. Within condenser 184, heat exchange with ambient air takes place so as to cool the refrigerant and cause the refrigerant to condense to a liquid state.

Expansion device (e.g., a valve, capillary tube, or other restriction device) 186 receives liquid refrigerant from condenser 184. From expansion device 186, the liquid refrigerant enters evaporator 188. Upon exiting expansion device 186 and entering evaporator 188, the liquid refrigerant drops in pressure and vaporizes. Due to the pressure drop and phase change of the refrigerant, evaporator 188 is cool relative to fresh food and freezer chambers 122 and 124 of refrigerator appliance 100. As such, cooled air is produced and refrigerates fresh food and freezer chambers 122 and 124 of refrigerator appliance 100. Thus, evaporator 188 is a heat exchanger which transfers heat from air passing over evaporator 188 to refrigerant flowing through evaporator 188.

It is noted that although a sealed system is described above (e.g., as a thermodynamic assembly), one of ordinary skill in the art would, in light of the present disclosure, understand that such a sealed system may be substituted for other suitable heat-exchange systems, such as a system relying on shape-memory alloys (SMA). For instance, a pair of discrete fluid circuits (e.g., a hot circuit and a cold circuit) each having a discrete volume of heat-carrying fluid (e.g., water, brine, glycol, air, etc.) may be separately connected to a compression unit housing a plurality of plate stacks each having one or more plates formed from one or more SMA material (e.g., copper-nickel-aluminum or nickel-titanium). Separate heat exchangers may generally be provided on the circuits in place of the evaporator and the condenser of a sealed system. In particular, a first heat exchanger may be provided on the cold circuit (e.g., in place of the evaporator 188) to absorb heat from the adjacent air and impart such absorbed heat to the heat-carrying fluid within the cold circuit. Thus, the first heat exchanger may also be referred to as an "evaporator" herein. Similarly, a second heat exchanger may be provided on the hot circuit (e.g., in place of the condenser 184) to release heat to the adjacent air from the heat-carrying fluid within the hot circuit. Thus, the second heat exchanger may also be referred to as a "condenser" herein.

The compression unit may facilitate or direct heat between the circuits. As an example, the compression unit may have four discrete plate stacks, each being separately compressed or released by a corresponding compressor or vice (e.g., hydraulic ram or electric actuator). During use, the plate stacks may be compressed and released (e.g., alternated between a compressed state or stroke and a released state or stroke) separately such that at any given moment one plate stack is compressed, one plate stack is released, one plate stack is mid-compression, and one plate stack is mid-release. Heat-carrying fluid in the cold circuit may flow through the first heat exchanger, before being directed (e.g., by a series of valves or pumps) into the plate stack that is currently compressed. The compressed plate stack may then be moved to the released state, in turn absorbing heat from the heat-carrying fluid before the heat-carrying fluid within the now-released plate stack is returned to the cold circuit (e.g., to repeat the cycle). In contrast to the cold circuit, heat-carrying fluid in the hot circuit may flow through the second heat exchanger and be directed (e.g., by a separate series of valves or pump) into the plate stack that is currently released. The released plate stack may then be compressed (i.e., moved to the compressed stated), in turn releasing heat from the plate stack to the heat-carrying fluid before the heat-carrying fluid within the now-compressed plate stack is returned to the hot circuit (e.g., to repeat the cycle). The use of four plate stacks may allow both circuits to run continuously.

Refrigerator appliance 100 further includes a controller 194. Operation of the refrigerator appliance 100 is regulated by controller 194 that is operatively coupled to control panel 148. In one exemplary embodiment, control panel 148 may represent a general purpose I/O ("GPIO") device or functional block. In another exemplary embodiment, control panel 148 may include input components, such as one or more of a variety of electrical, mechanical or electro-mechanical input devices including rotary dials, push buttons, touch pads, and touch screens. Control panel 148 may be operably connected in communication with controller 194 via one or more signal lines or shared communication busses. Control panel 148 provides selections for user manipulation of the operation of refrigerator appliance 100. In response to user manipulation of the control panel 148, controller 194 operates various components of refrigerator appliance 100. For example, controller 194 is operatively connected or in communication with compressor 182, ice-making assembly 300, and fan 192, such that controller 194 can operate such components.

Controller 194 includes memory and one or more processing devices such as microprocessors, CPUs or the like, such as general or special purpose microprocessors operable to execute programming instructions or micro-control code associated with operation of refrigerator appliance 100. The memory can represent random access memory such as DRAM, or read only memory such as ROM or FLASH. The processor executes programming instructions stored in the memory. For certain embodiments, the instructions include a software package configured to operate appliance 100 (e.g., according to an ice-making operation, such as method 600 described below). The memory can be a separate component from the processor or can be included onboard within the processor. Alternatively, controller 194 may be constructed without using a microprocessor, e.g., using a combination of discrete analog or digital logic circuitry (such as switches, amplifiers, integrators, comparators, flip-flops, AND gates, and the like) to perform control functionality instead of relying upon software.

Turning now generally to FIGS. 4 through 15, an exemplary ice-making assembly 300 will be described in greater detail. As noted above, an ice-making assembly 300 may be mounted within IB compartment 160 and may, thus, move with the door 128 relative to the cabinet 102. Various directions (e.g., vertical direction V, lateral direction L, and transverse direction T) are described below with respect to the ice-making assembly 300. Generally, such directions correspond to the door 128 in the closed position. Thus, although overall compartment 160 may move relative to the defined directions, and for the sake of clarity, the below disclosure describes various portions relative to the same defined directions (e.g., when door 128 is in the closed position). Moreover, relative directions, such as forward, rearward, left, or right are described below as they would naturally be understood when a user is viewing the ice-making assembly 300, such as when the door 128 is open for a user to access ice-making assembly 300 (e.g., to remove one or more ice billets 320 therefrom). The below description is understood not to limit the movement or orientation of overall ice-making assembly 300 or IB compartment 160, except as otherwise indicated.

Generally, ice-making assembly 300 includes a mold assembly 310 having a conductive ice mold 340 that defines a mold cavity 318 within which an ice billet 320 may be formed. As with other portions of ice-making assembly 300, the ice mold 340 is generally held within the IB compartment 160. Moreover, as will be described in detail below, one or more freezing elements 325 (e.g., fan 192 or TEHE 348) may be provided in thermal communication with the conductive ice mold 340 (e.g., within IB compartment 160 or outside of IB compartment 160, such as at a separate portion of cabinet 102) to selectively draw heat from the mold cavity 318 (e.g., for the formation of ice billet 320).

In optional embodiments, mold assembly 310 is connected or mounted to an air conduit 326 defining a sealed or isolated conduit air path 334 within IB compartment 160 in fluid communication between the supply duct 166 and the return duct 168. In particular, the air conduit 326 provides a duct or pipe having a conduit inlet 356 and a conduit outlet 366 through which air may flow (e.g., while being isolated from or held out of mold cavity 318 or the surrounding portion of icebox compartment 160). When assembled, air conduit 326 may be in fluid communication with at least a portion of the thermodynamic assembly 180. For instance, the evaporator 188 may be in fluid communication with air conduit 326 such that chilled air flowed across the evaporator 188 (e.g., as motivated by the fan 192) may pass to and through the air conduit 326 before being returned. Specifically, air may flow along an overall flow path from the evaporator 188, to the chilled air supply duct 166, to the air conduit 326 through the conduit inlet 356, from the air conduit 326 through the conduit outlet 366, to the chilled air return duct 168, and again to the evaporator 188. The fan 192 itself may be mounted along the overall flow path to motivate the chilled air and include any suitable fan or blower (e.g., axial fan, tangential fan, impeller, etc.). Moreover, although a circuit or cycle for air may be provided, the conduit inlet 356 may be understood to be downstream from supply duct 166, while conduit outlet 366 is downstream from the conduit inlet 356 or upstream from the return duct 168. Stated again, the conduit inlet 356 may be downstream from the chilled air supply duct 166 to receive an airflow from the thermodynamic assembly 180 (FIG. 3), and the conduit outlet 366 may be upstream from the chilled air return duct 168 to direct the airflow to the chilled air return duct 168.

Optionally, along with or as part of air conduit 326, a heat exchange (HE) sleeve 338 may be disposed on air conduit 326 (e.g., attached to air conduit 326). HE sleeve 338 may generally be formed from or include a conductive metal (e.g., copper or aluminum, including alloys thereof) and, for example, define at least a portion of conduit path 334. In some embodiments, HE sleeve 338 is joined directly to ice mold 340 (e.g., as a discrete or unitary element with air conduit 326) and is in conductive thermal communication with the surrounding or adjacent portions of air conduit 326 (e.g., to conduct heat to the air conduit 326). Additionally or alternatively, HE sleeve 338 may include a conductive panel 342 (e.g., one or more fins, perforated panels, cells, etc.) that extends across the conduit path 334. Conductive panel 342 may be formed from a conductive metal (e.g., copper or aluminum, including alloys thereof) and may include the same material or, alternatively, a different material from the rest of HE sleeve 338 (e.g., a collar defining a portion of conduit path 334). Conductive panel 342 is generally provided in conductive thermal communication with ice mold 340. During use, the air flowing along the conduit path 334 through the HE sleeve 338 may thus be used to selectively draw heat (e.g., via conductive or convective heat transfer) from mold cavity 318. Notably, such heat exchange may facilitate reliable and efficient air cooling (e.g., to produce substantially clear ice billets 320 outside of a chamber for storing food).

One or more temperature sensors 360 (e.g., thermistor, thermocouple, etc.) may be provided in thermal communication with the mold assembly 310 (e.g., on or within the air path 334 or ice mold 340) to detect a temperature for or the mold assembly 310.

Optionally, mold assembly 310 may further include a thermal electric heat exchanger (TEHE) 348 mounted thereon (e.g., in conductive thermal communication between an ice mold 340 and the corresponding HE sleeve 338). Generally, TEHE 348 may be any suitable solid state, electrically-driven heat exchanger, such as a Peltier device. TEHE 348 may include a first heat exchange end and a second heat exchange end. When activated, heat may be selectively directed between the ends. In particular, a heat flux created between the junction of the ends may draw heat from one end to the other end (e.g., as driven by an electrical current). In some embodiments, TEHE 348 is operably coupled (e.g., electrically coupled) to a controller 194, which may thus control the flow of current to TEHE 348. During use (e.g., in a freezing mode or configuration), TEHE 348 may act as a freezing element 325 to selectively draw heat from mold cavity 318 (e.g., which may then be transferred to the air path 334) as would be understood.

Although TEHE 348 may generally be configured to operate in a freezing mode as a freezing element 325, the heat differential between the first heat exchange end and the second heat exchange end may be reversed (e.g., as would be understood) to provide a heating mode such that TEHE 348 operates as heating element (e.g., during harvest sequences) to heat mold cavity 318 and at least partially melt or release an ice billet 320 from mold cavity 318. Additionally or alternatively, one or more dedicated heating elements may be provided to at least partially melt or release an ice billet 320 from mold cavity 318. Such dedicated heating element(s) may, for instance, be mounted on or above ice mold 340 or mold cavity 318. Any suitable electrically driven heater, such as a resistance wire, infrared heating element, or induction element, may be provided as or as part each heating element 349.

A water dispenser 314 positioned below mold assembly 310 may generally act to selectively direct the flow of water into mold cavity 318 (e.g., outside of air conduit 326). Generally, water dispenser 314 includes a water pump 322 and at least one nozzle 324 directed (e.g., vertically) toward mold cavity 318. As shown, mold cavity 318 may be vertically aligned with nozzle 324.

In some embodiments, a water basin 316 is positioned below the ice mold 340 (e.g., directly beneath mold cavity 318 along the vertical direction V). Water basin 316 includes a solid nonpermeable body defining a water reservoir 328 or interior volume 328. For instance, the solid nonpermeable body may include a bottom basin wall 370 and one or more side basin walls 372 that define water reservoir 328. As shown, the side basin walls 372 may be provided as vertical sidewalls that further define a vertical opening in fluid communication with mold cavity 318. When assembled, fluids, such as excess water falling from mold cavity 318, may pass into interior volume 328 of water basin 316 through the vertical opening. Additionally or alternatively, a water supply line 378 (e.g., in fluid communication with a suitable water source) may be provided upstream from interior volume 328 to selectively provide water thereto (e.g., as directed by controller 194 via one or more suitable pumps, valves, etc., as would be understood). Further additionally or alternatively, and as will be described in greater detail below, water basin 316 may be removable from IB compartment 160 (e.g., by and as desired by a user) and, thus, removably disposed on or within IB compartment 160.

In certain embodiments, an electrical basin plug 380 is provided on water basin 316. For instance, electrical basin plug 380 may be fixed or fixedly mounted on a basin wall 370, 372. In turn, electrical basin plug 380 is generally included with water basin 316 and may move therewith. In certain embodiments, electrical basin plug 380 is fixed to one of the side basin walls 372. As shown, electrical basin plug 380 may be directed horizontally. Optionally, electrical basin plug 380 is fixed to a rear side basin wall 372 and, thus, faces a forward-facing internal wall of inner liner 132.

Generally, electrical basin plug 380 is provided as any suitable electrical contact or connector to electrically connect to a mated connector (e.g., when in contact with the same). For instance, electrical basin plug 380 may be configured to match or selectively contact a separate plug 382 within IB compartment 160. In some embodiments, an electrical stationary plug 382 is fixed to the liner 132 within IB compartment 160. Specifically, electrical stationary plug 382 may be aligned in selective contact with the electrical basin plug 380 (e.g., to connect to the same when water basin 316 is received within IB compartment 160). For instance, electrical stationary plug 382 and electrical basin plug 380 may be provided at a common vertical height and lateral position such that an electrical connection is formed by contact between (or interlocking of) the two. To that end, electrical stationary plug 382 may be fixed to the forward-facing internal wall of inner liner 132. When assembled, electrical stationary plug 382 may be in electrical communication with controller 194 or one or more power sources. In turn, electrical stationary plug 382 may facilitate data or power transmission to electrical basin plug 380 from such power sources or controller 194.

Separate from or in addition to the selective electrical connection with electrical stationary plug 382, electrical basin plug 380 may be electrically connected to (i.e., in electrical communication with) one or more electrical components on the water basin 316.

In some embodiments, fluid pump 322 is attached to water basin 316 (e.g., within or as part of water dispenser 314). For instance, fluid pump 322 may be fixed to one or more basin walls 370, 372 in fluid communication with the water reservoir 328. In some such embodiments, fluid pump 322 is mounted to bottom basin wall 370 within water reservoir 328. In additional or alternative embodiments, fluid pump 322 is in electrical communication with the electrical basin plug 380 (e.g., via one or more suitable wires, electrical busses, etc.) and may, thus, receive data or power through electrical basin plug 380.

In additional or alternative embodiments, a liquid level sensor 384 is attached to water basin 316 (e.g., within or as part of water dispenser 316). For instance, liquid level sensor 384 may be fixed to one or more basin walls 370, 372 in fluid communication with the water reservoir 328. In some such embodiments, liquid level sensor 384 is mounted to bottom basin wall 370 within water reservoir 328. In additional or alternative embodiments, liquid level sensor 384 is in electrical communication with the electrical basin plug 380 (e.g., via one or more suitable wires, electrical busses, etc.) and may, thus, exchange data (e.g., with controller 194) or power through electrical basin plug 380.

Generally, the liquid level sensor 384 may sense a level of liquid contained within water reservoir 328. In some embodiments, liquid level sensor 384 is in operable communication with controller 194. For instance, liquid level sensor 384 may communicate with the controller 194 via one or more signals. In certain embodiments, liquid level sensor 384 includes a predetermined or set threshold level (e.g., to indicate the need for additional liquid to water reservoir 328). In particular, liquid level sensor 384 may detect if or when the liquid water reservoir 328 is below the predetermined threshold level. Optionally, liquid level sensor 384 may be a two-position sensor (e.g., float or reed switch). In other words, liquid level sensor 384 may either be "on" or "off," depending on a level of liquid.

For example, when the liquid level is above the predetermined threshold level, liquid level sensor 384 is "off," meaning it does not send a signal to the water supply line 378 via controller 194 (e.g., to pump or release liquid from water supply line 378 to water reservoir 328). For another example, when the liquid level is below the predetermined threshold, liquid level sensor 384 is "on," meaning it sends a signal to water supply line 378 via controller 194 (e.g., to pump or release liquid from water supply line 378 to water reservoir 328). It should be understood that liquid level sensor 384 may be any suitable sensor capable of determining a level of liquid within water reservoir 328 (e.g., pressure sensor, capacitance sensor, light sensor, etc., as would be understood in light of the present disclosure), and the disclosure is not limited to those examples provided herein.

In some embodiments, a water filter 385 may be connected to water basin 316. The water filter 385 may filter out solid contaminants from water in the water reservoir 328. The water filter 385 may be provided downstream from fluid pump 322. Additionally or alternatively, the water filter 385 may be provided upstream from nozzle 324. In some such embodiments, the water filter 385 is provided along a flow path between fluid pump 322 and nozzle 324, such that water passes from water reservoir 328 through the filter before being dispensed by nozzle 324. The water filter 385 may include a filter medium which performs the actual filtration. For example, the filter medium may be a deionization filter. Nonetheless, it should be understood that various additional or alternative suitable filter mediums or devices may be incorporated as the filter medium, or the filter may be omitted entirely.

In certain embodiments, a guide ramp 330 is positioned between mold assembly 310 and water reservoir 328 along the vertical direction V. As will be described in greater detail below guide ramp 330 generally extends and descends from a first end 330-1 (e.g., proximal to mold assembly 310 and, thus, distal to water reservoir 328) to a second end 330-2 (e.g., proximal to water reservoir 328 and, thus, distal to mold assembly 310). Guide ramp 330 may be held on water basin 316 and provide at least one segment proximal to second end 330-2 on which ice billets 320 may be held. For instance, guide ramp 330 may bend or snake from an upper segment 330A to a lower segment 330B on which ice billets 320 may be held. Ice billets 320 formed within mold cavity 318 may be expelled from mold assembly 310 and subsequently stored on guide ramp 330 (e.g., within IB compartment 160). In some such embodiments, the storage portion of guide ramp 330 is positioned within IB compartment 160 and horizontally spaced apart from water dispenser 314 or mold assembly 310. At least a portion of the upper segment 330A (e.g., at first end 330-1) may span a horizontal distance that is directly beneath mold cavity 318. Moreover, upper segment 330A may be higher than but lead to lower segment 330B (e.g., via one or more bends or U-shaped segments 330C). As ice billets 320 descend or fall from mold cavity 318, the ice billets 320 may thus be motivated (e.g., by gravity) from the upper segment 330A toward the lower segment 330B.

As shown, controller 194 may be in communication (e.g., electrical communication) with one or more portions of ice-making assembly 300. In some embodiments, controller 194 is in communication with one or more fluid pump (e.g., water pump 322), a TEHE 348, and fan 192. Controller 194 may be configured to initiate discrete ice making operations and ice release operations. For instance, controller 194 may alternate the fluid source spray to mold cavity 318 and a release or ice harvest process, which will be described in more detail below.

During ice making operations, controller 194 may initiate or direct water dispenser 316 to motivate a water spray (e.g., as indicated at arrows 346) through nozzle 324 and into mold cavity 318 (e.g., a through mold opening at the bottom end of mold cavity 318). Optionally, at least a portion of the water spray may be a warming spray of relatively warm water (e.g., recently added to the water reservoir 328) while one or more freezing elements 325 are turned off or otherwise held in an inactive state. Notably, accumulated frost or ice particles may be removed from mold cavity 318 prior to billet formation. Additionally or alternatively, clouding of ice billets 320, which may otherwise be caused by excessively rapid freezing, may be prevented.

After the warming spray, if any, controller 194 may direct fan 192 to motivate a chilled airflow (e.g., from evaporator 188 or the conduit path 334) to convectively draw heat from within mold cavity 318 while an ice building water spray is directed into the mold cavity 318. As the water from the ice-building spray strikes mold assembly 310 within mold cavity 318, a portion of the water may freeze in progressive layers from top wall 344 to a bottom end of mold cavity 318. Excess water (e.g., water within mold cavity 318 that does not freeze upon contact with mold assembly 310 or the frozen volume herein) and impurities within the ice-building spray may fall from mold cavity 318 and, for example, to water basin 316. After an initial portion of ice has formed within the mold cavity 318, controller 194 may optionally activate the TEHE 348 to further draw heat from the ice mold cavity 318, thereby accelerating freezing of ice billet 320, notably, without requiring a significant power draw.

Once an ice billet 320 is formed within mold cavity 318, an ice release or harvest process may be performed in accordance with embodiments of the present disclosure. Optionally, a new warming or harvest spray of relatively warm water (e.g., recently added to the water reservoir 328) may be directed toward the formed ice billet 320. Notably, the bottom portion of the frozen ice billet 320 within mold cavity 318 may be rounded, which may improve release or eliminate accumulated portions of ice along the edges or outer surface of ice mold 340. Additionally or alternatively, the falling of melted water to the water basin 316 may chill water within the water reservoir 328.

During the harvest process, fan 192 may be restricted or halted to slow/stop the active chilled airflow. Moreover, controller 194 may first halt or prevent the ice-building spray by de-energizing water pump 322. Additionally or alternatively, an electrical current to the TEHE 348 may be reversed such that heat is delivered to mold cavity 318 from TEHE 348. Thus, controller 194 may slowly increase a temperature TEHE 348 and ice mold 340, thereby facilitating partial melting or release of ice billet 320 from a top portion of mold cavity 318.

In optional embodiments, ice mold 340 may include a top wall 344 and a plurality of sidewalls 350 that are cantilevered from top wall 344 and extend downward from top wall 344. More specifically, according to the illustrated embodiment, ice mold 340 includes eight sidewalls 350 that include an angled portion 352 that extends away from top wall 344 and a vertical portion 354 that extends down from angled portion 352 substantially along the vertical direction. In this manner, the top wall 344 and the plurality of sidewalls 350 form a mold cavity 318 having an octagonal cross-section when viewed in a horizontal plane. In addition, each of the plurality of sidewalls 350 may be separated by a gap 358 that extends substantially along the vertical direction V. In this manner, the plurality of sidewalls 350 may move relative to each other and act as spring fingers to permit some flexing of ice mold 340 during ice formation. Notably, this flexibility of ice mold 340 facilitates improved ice formation and reduces the likelihood of cracking.

In general, ice mold 340 may be formed from any suitable material and in any suitable manner that provides sufficient thermal conductivity to transfer heat to the surrounding environment and air conduit 326 (e.g., through a heat exchange sleeve 338) to facilitate the ice making process. According to an exemplary embodiment, ice mold 340 is formed from a single sheet of copper. In this regard, for example, a flat sheet of copper having a constant thickness may be machined to define top wall 344 and sidewalls 350. Sidewalls 350 may be subsequently bent to form the desired shape of mold cavity 318 (e.g., such as the octagonal or gem shape described above). In this manner, top wall 344 and sidewalls 350 may be formed to have an identical thickness without requiring complex and costly machining processes.

According to exemplary embodiments of the present disclosure, HE sleeve 338 is mounted at or above top wall 344. When mounted, HE sleeve 338 is generally in conductive thermal communication with top wall 344 (e.g., in direct mutual contact, through one or more intermediate welds or solder points, or through TEHE 348 mounted between HE sleeve 338 and ice mold 340). In addition, HE sleeve 338 or TEHE 348 may not be in direct contact with sidewalls 350. This may be desirable, for example, to prevent restricting the movement of sidewalls 350 (e.g., to reduce to the likelihood of ice cracking). Notably, in embodiments wherein HE sleeve 338 or TEHE 348 is mounted only on top wall 344, the conductive path to each of the plurality of sidewalls 350 is through the joint or connection where sidewalls 350 meet top wall 344.

In some embodiments, such as to improve the thermal contact between HE sleeve 338 and ice mold 340, it may be desirable to make top wall 344 relatively large. Therefore, according to exemplary embodiments, top wall 344 may define a top width 362 and mold cavity 318 may define a max width 364. According to exemplary embodiments, top width 362 is greater than about 50% of max width 364. According to still other embodiments, top width 362 may be greater than about 60%, greater than about 70%, greater than about 80%, or greater, of max width 364. In addition, or alternatively, top width 362 may be less than 90%, less than 70%, less than 60%, less than 50%, or less, of max width 364. It should be appreciated that other suitable sizes, geometries, and configurations of ice mold 340 are possible and within the scope of the present disclosure.

A noted above, water basin 316 may removably mounted or disposed within IB compartment 160. For instance, water basin 316 may be slidably disposed. Thus, water basin 316 may be selectively slid (e.g., along the transverse direction T) by a user in and out of IB compartment 160 at a predetermined location beneath ice mold 340. Optionally, complementary portions of liner 132 and water basin 316 may be formed to guide movement (e.g., sliding) of water basin 316 relative to liner 132. In some such embodiments, the liner 132 defines one or more horizontal grooves 396 at a surface disposed below the ice mold or water basin 316 (e.g., to support the water basin 316 within IB compartment 160. The horizontal grooves 396 may extend, for instance, along or parallel to the transverse direction L. One or more horizontal rails 398 may be included (e.g., on a bottom portion or surface of water basin 316). The horizontal rails 398 may generally be matched to the horizontal grooves 396 such that the horizontal rails 398 may fit therein. When assembled, the horizontal rails 398 may thus be slidably received within the one or more horizontal grooves 396.

Moreover, the interaction of the rails 398 and grooves 396 may direct transverse movement or sliding of water basin 316—and any components fixed to the water basin 316—relative to the IB compartment 160 or liner 132. For instance, as the water basin 316 is moved into and out of the IB compartment, electrical basin plug 380 may simultaneously be moved into and out of engagement (e.g., contact) with the stationary electrical plug 382.

In optional embodiments, guide ramp 330 may be supported on water basin 316 (e.g., in attachment therewith). For instance, one or more support ridges 395 may extend from or be defined on a perimeter portion of guide ramp 330 to rest along an upper rim of the water basin 316 (e.g., as defined at one or more side basin walls 372).

As noted above, the guide ramp 330 generally extends from a first end 330-1 to a second end 330-2 and includes an upper segment 330A and a lower segment 330B on which ice billets 320 may be received (e.g., and held until melted or removed by a user). In particular, guide ramp 330 includes a ramp surface 331 (e.g., at the upper and lower segments 330A, 330B) along with ice billets 320 may slide or rest. Optionally, one or more side rails 332 (e.g., a pair of side rails 332) may extend upward from the upper segment 330A and the lower segment 330B. For instance, from one or more outer edges of the ramp surface 331, one or more side rails 332 may extend along a direction that is generally vertical or otherwise non-orthogonal to the vertical direction V (e.g., between 0° and 45° relative to the vertical direction V). Such side rails 332 may horizontally contain ice billets 320 as they slide or rest along the upper and lower segments 330A, 330B.

As shown, the upper segment 330A and the lower segment 330B may extend at discrete angles relative to a horizontal plane PH (e.g., at the ramp surface 331). In particular, the upper segment 330A may extend along a first pitch angle θP1 relative to the lateral direction L (e.g., between the first end 330-1 and an upper limit of the U-shaped segment 330C). In some embodiments, the first pitch angle θP1 is defined at a substantially transverse middle portion of the ramp surface 331 between the pair of side rails 332 at the upper segment 330A (e.g., equidistance from the pair of side rails 332). Additionally or alternatively, the lower segment 330B may extend along a second pitch angle θP2 relative to the lateral direction L (e.g., between a lower limit of the U-shaped segment 330C and the second end 330-2). In some embodiments, the second pitch angle θP2 is defined at a substantially transverse middle portion of the ramp surface 331 between the pair of side rails 332 at the lower segment 330B (e.g., equidistance from the pair of side rails 332).

As noted, the first pitch angle θP1 may be different from the second pitch angle θP2. As an example, the first pitch angle θP1 may be different in guided direction (e.g., descending from left to right) from the guided direction of the second pitch angle θP2 (e.g., descending from left to right). The U-shaped segment 330C may redirect the guide ramp 330 (e.g., ramp surface 331) from the upper segment 330A to the lower segment 330B. As an additional or alternative example, the absolute value of the first pitch angle θP1 (e.g., relative to the lateral direction L) may be different from (e.g., greater than) the absolute value of the second pitch angle θP2 (e.g., relative to the lateral direction L).

Separate from or in addition to the second pitch angle θP2, the lower segment 330B may define a non-parallel roll angle θR for or at the ramp surface 331. For instance, the non-parallel roll angle θR may be defined from one side rail 332 to an opposite side rail 332 of the pair of side rails 332 (e.g., relative to the transverse direction T). Thus, one side rail 332 (e.g., transversely proximal to the upper segment 330A or a rear portion of assembly 300) may be disposed higher than the opposite side rail 332 (e.g., transversely distal to the upper segment 330A or a rear portion of assembly 300). Notably, ice billets 320 resting on the lower segment 330B may be angled slightly forward for presentation to a user opening the door 128-FIG. 1). Generally, the non-parallel roll angle θR may be defined relative to a horizontal direction (e.g., transverse direction T) and have an absolute value greater than 0° (e.g., between 5° and 45°).

In order to help retain ice billets 320 directly on guide ramp 330, a vertical stopper wall 336 may be disposed at the second end 330-2 of guide ramp 330. Thus, as ice billets 320 slide along guide ramp 330, the ice billets 320 may be horizontally contained by the vertical stopper wall 336 and permitted to accumulated (e.g., sequentially) on guide ramp 330. Stopper wall 336 may be formed, for instance, as a continuation of a basin wall 370, 372 that extends to a greater height than the ramp surface 331 at second end 330-2. Alternatively, though, stopper wall 336 may extend directly from ramp surface 331 or another suitable member at second end 330-2.

Although guide ramp 330 includes a ramp surface 331 to support one or more ice billets 320, guide ramp 330 may define one or more relatively small openings to permit the flow of melted or excess water from the water dispenser 316.

As an example, guide ramp 330 may define a plurality of drain slots 399A. Such drain slots 399A may be defined, for instance, along the vertical direction V (e.g., at upper segment 330A) through ramp surface 331. Drain slots 399A may be directly above water reservoir 328 (e.g., at a height between mold cavity 318 and interior volume 328). Moreover, the drain slots 399A may be significantly smaller than the ice billets 320 such that the ice billets 320 may slide over the drain slots 399A without passing therethrough. Fluids, such as water, may thus generally pass through the drain slots 399A and to interior volume 328.

As an additional or alternative example, guide ramp 330 may define at least one vertical melt or ice aperture 399B. Such a vertical ice aperture 399B may be defined, for instance, along the vertical direction V through the ramp surface 331 at the second end 330-2. The vertical ice aperture 399B may be above the water reservoir 328 and in fluid communication therewith (e.g., upstream fluid communication). In certain embodiments, the maximum horizontal aperture width AM (i.e., largest horizontal maximum of vertical ice aperture 399B) is smaller than a maximum horizontal mold width MM of mold cavity 318 (e.g., 364). In other words, the maximum horizontal mold width MM, which at least partially defines ice billets 320 formed therein, is larger than the maximum horizontal aperture width AM of vertical ice aperture 399B. For instance, the horizontal aperture width AM may be between 60% and 90% of maximum horizontal mold width MM. Thus, the ice billets 320 formed in (and released from) ice mold 340 are generally larger than the vertical ice aperture 399B and may rest thereabove without immediately passing through. Nonetheless, as an ice billet 320 melts, water therefrom may pass through the vertical ice aperture 399B and to the water basin 316. If left for an extend period of time, the remaining solid portion of an ice billet 320 may even pass through horizontal aperture width AM and to water basin 316. Notably, the ice billets 320 within IB compartment 160 may be regularly refreshed (e.g., even if left unattended by a user for an extended period of time).

In optional embodiments, a limiting switch 386 is further provided to detect the accumulation of ice billets 320 on guide ramp 330. For instance, limiting switch 386 may be directed into a path of the guide ramp 330 at the upper segment 330A. As shown, limiting switch 386 may be mounted on a side rail 332 of guide ramp 330. Additionally or alternatively, limiting switch 386 may be held at the upper segment 330A.

Generally, limiting switch 386 may be provided as any suitable limit switch configured to detect the presence of an object at a predetermined location, such as a reed switch, light sensor, capacitance sensor, pressure sensor, etc. Thus, accumulation of multiple ice billets 320 up to the upper segment 330A may be automatically detected. In some embodiments, limiting switch 386 is in operable communication with controller 194 and configured to transmit one or more signals (e.g., "on" or "off") in response to detecting an ice billet 320 at the predetermined location. Additionally or alternatively, the limiting switch 386 may be configured to halt ice-making operations (e.g., halt the spray of water from water dispenser 316) in response to detecting an ice billet 320 at the predetermined location.

As shown, water dispenser assembly 314, including a dispenser base 368 and one or more nozzles (e.g., removable spray caps 374), may be used with ice-making assembly 300 will be described according to exemplary embodiments of the present disclosure. Specifically, for example, dispenser base 368 and spray cap 374 may be used as (or as part of) guide ramp 330 and nozzle 324, respectively. Thus, water dispenser 314 may be positioned below (e.g., directly below) the ice mold 340 to direct an ice-building spray of water to the mold cavity 318.

As shown, the dispenser base 368 generally defines a water path through which water may flow to a corresponding spray cap 374. For instance, a conduit 376 may be provided to or beneath spray cap 374 and define the water path. Thus, water path may be upstream from the spray cap 374. Moreover, when assembled the water path may be upstream from pump 322, as would be understood in light of the present disclosure. In some embodiments, the conduit 376 of dispenser base 368 is joined to a upper segment 330A (e.g., as discrete or, alternatively, integral unitary member) on which spray cap 374 is selectively received.

In certain embodiments, upper segment 330A includes a cup wall 388 that defines a nozzle recess 390 within which a corresponding spray cap 374 is received. For instance, cup wall 388 may extend from or above conduit 376 such that nozzle recess 390 is defined as a vertically-open cavity through which the ice-building may flow. As shown, cup wall 388 and nozzle recess 390 may be positioned directly beneath or below at least a portion of the ramp surface 331 of guide. For instance, a bottom surface of cup wall 388 may extend horizontally from the ramp surface 331 of guide ramp 330. In other words, the bottom surface of cup wall 388 may extend away from a terminal edge and fail to cross a forward plane defined by the ramp surface 331 along the first pitch angle θP1. The resulting nozzle recess 390 may, in turn, have a side profile that is shaped as a right triangle (e.g., enclosed within the triangular side profile of upper segment 330A).

Generally, nozzle recess 390 defines a horizontal profile having one or more horizontal maximums. For instance, in the illustrated embodiments, nozzle recess 390 defines a lateral maximum LM and a transverse maximum TM that is larger than the lateral maximum LM. Alternative embodiments may have a circular profile and, thus, a single horizontal maximum or diameter. In certain embodiments, the maximum horizontal recess width (i.e., largest horizontal maximum of nozzle recess 390, such as lateral maximum LM) is smaller than a maximum horizontal mold width MM of mold cavity 318 (e.g., 364). In other words, the maximum horizontal mold width MM, which at least partially defines ice billets 320 formed therein, is larger than the maximum horizontal recess width of nozzle recess 390. Thus, the ice billets 320 formed in (and released from) ice mold 340 are generally larger than the opening to nozzle recess 390.

In optional embodiments, the maximum horizontal mold width MM is at least 50 percent larger than the maximum horizontal recess width (e.g., lateral maximum LM). In additional or alternative embodiments, the maximum horizontal recess width (e.g., lateral maximum LM) is less or equal to than 1.5 inches. In further additional or alternative embodiments, the maximum horizontal mold width MM is greater than or equal to 3 inches. In still further additional or alternative embodiments, the maximum horizontal mold width MM is about 1.5 inches while the maximum horizontal recess width is about 3 inches.

Advantageously, ice billets 320 may be prevented from falling into nozzle recess 390 or otherwise blocking the ice-building spray from spray cap 374.

As shown, spray cap 374 may be positioned on at least a portion of dispenser base 368 (e.g., within nozzle recess 390). Specifically, spray cap 374 is mountable downstream from a water path to direct an ice-building spray therefrom (e.g., along a vertical spray axis A towards a corresponding mold cavity 318-FIGS. 4 and 6). Generally, spray cap 374 includes a nozzle head 392 through which one or more outlet apertures 394 are defined. In particular, spray cap 374 extends across the vertical spray axis A while the outlet apertures 394 extend upward through spray cap 374. As water flows from the conduit 376, it may thus flow through the outlet apertures 394 as the ice-building spray.

Figure 5:
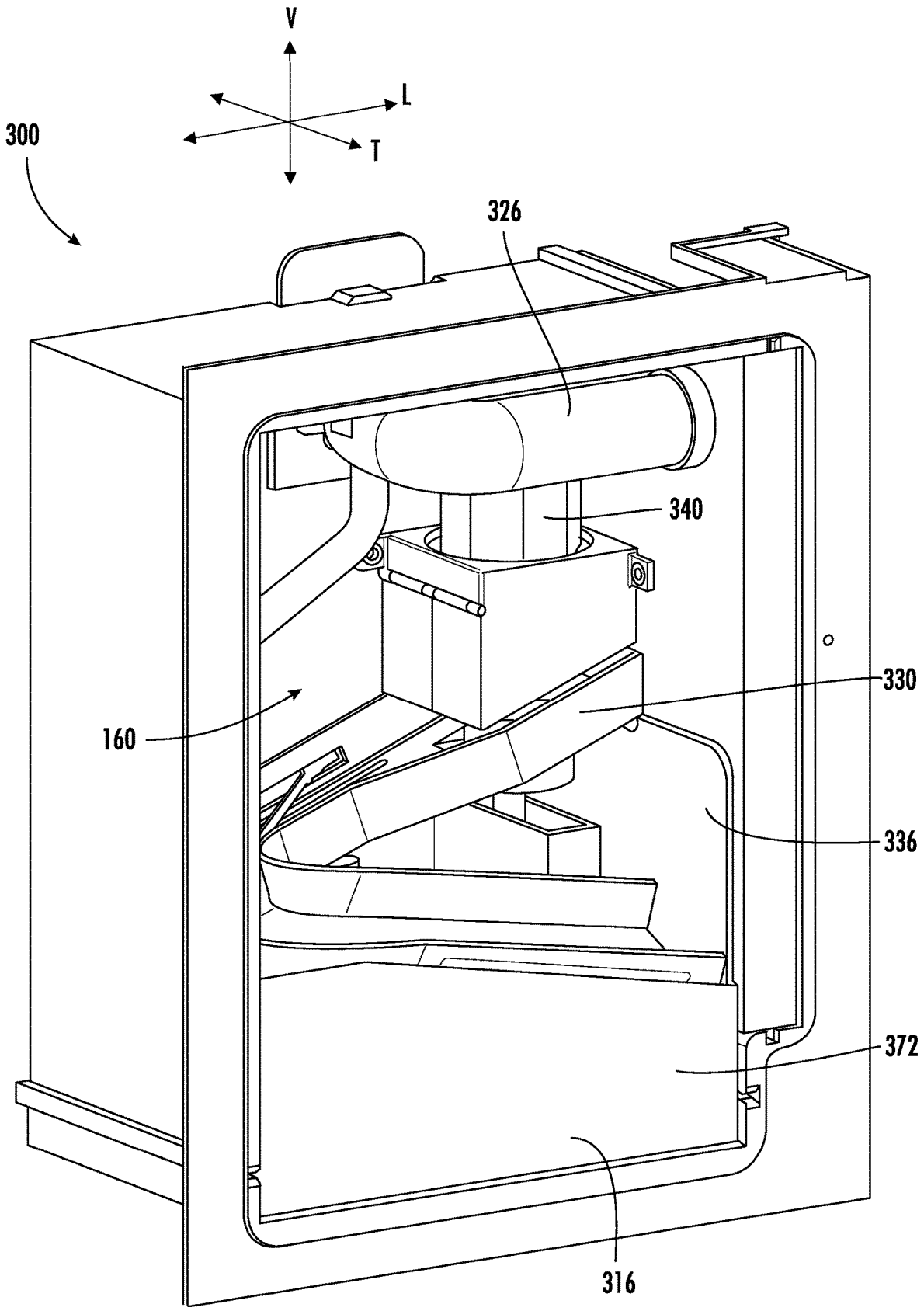
FIG. 5 provides a perspective view of an ice-making assembly, in isolation, of a refrigerator appliance according to exemplary embodiments of the present disclosure.
Figure 6:
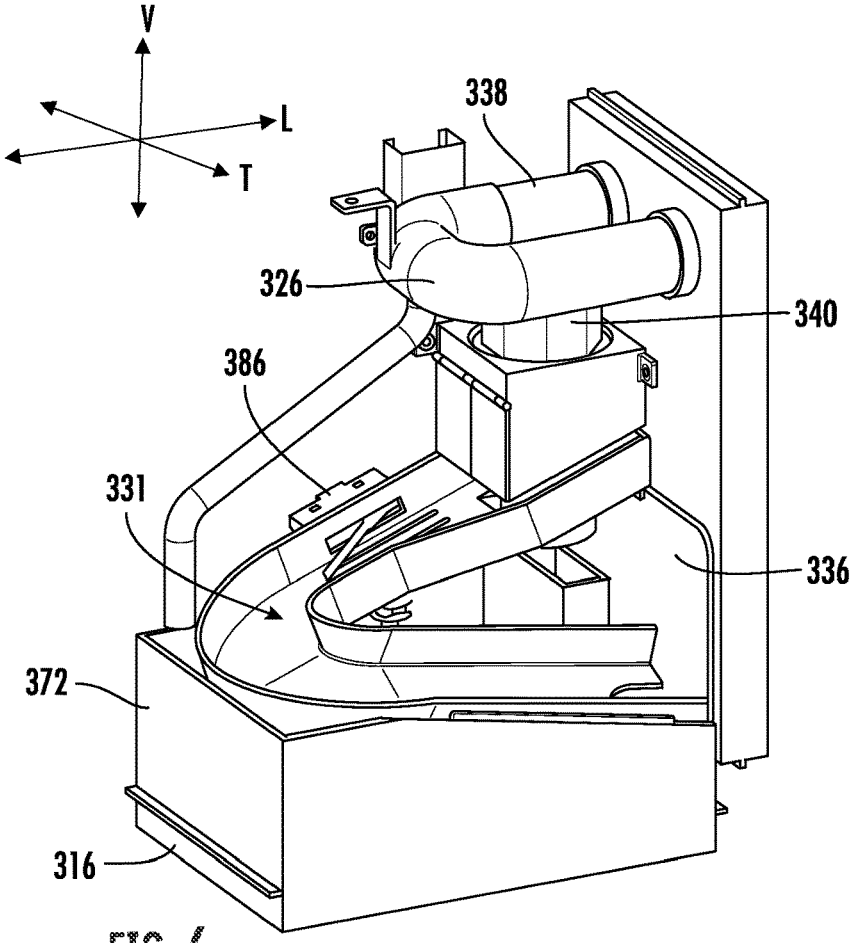
FIG. 6 provides a perspective view of a portion of the exemplary ice-making assembly of FIG. 1.
Figure 7:
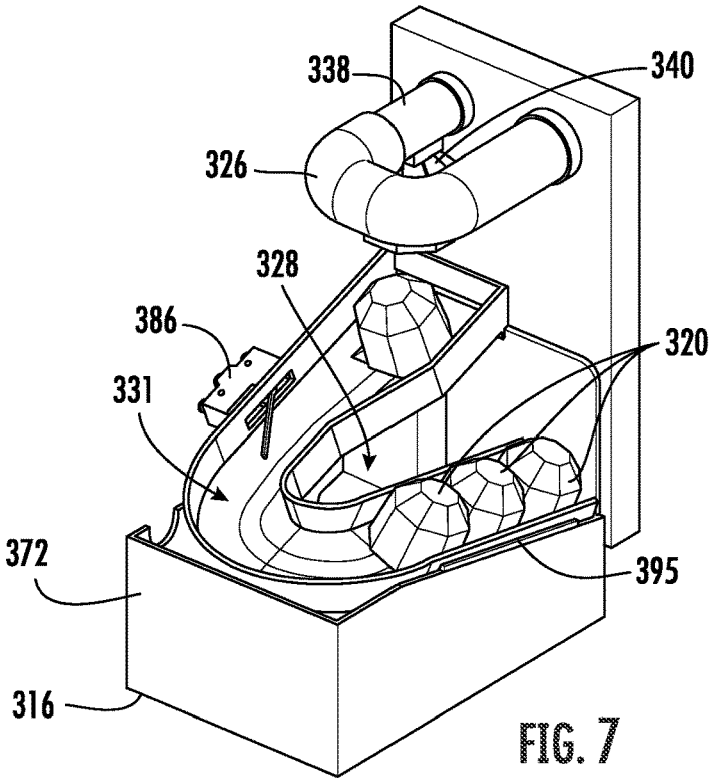
FIG. 7 provides a perspective view of a portion of the exemplary ice-making assembly of FIG. 1.
Figure 8:
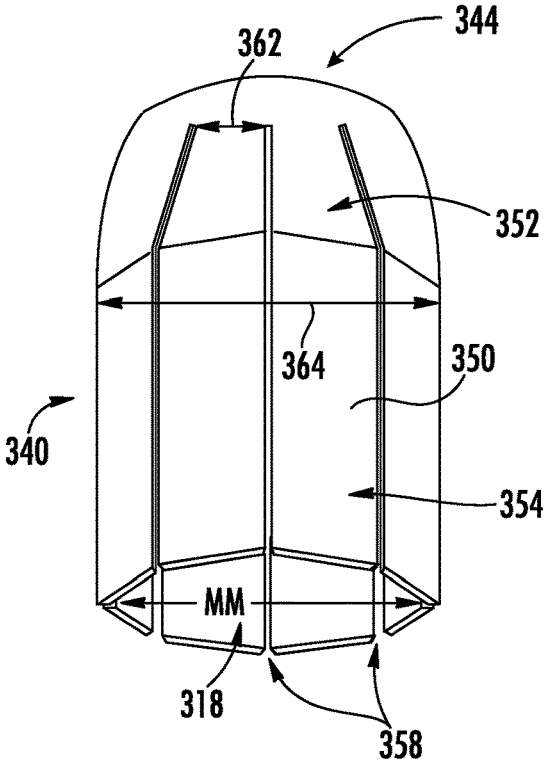
FIG. 8 provides a bottom perspective view of an ice mold of the exemplary ice-making assembly of FIG. 1.
Figure 9:
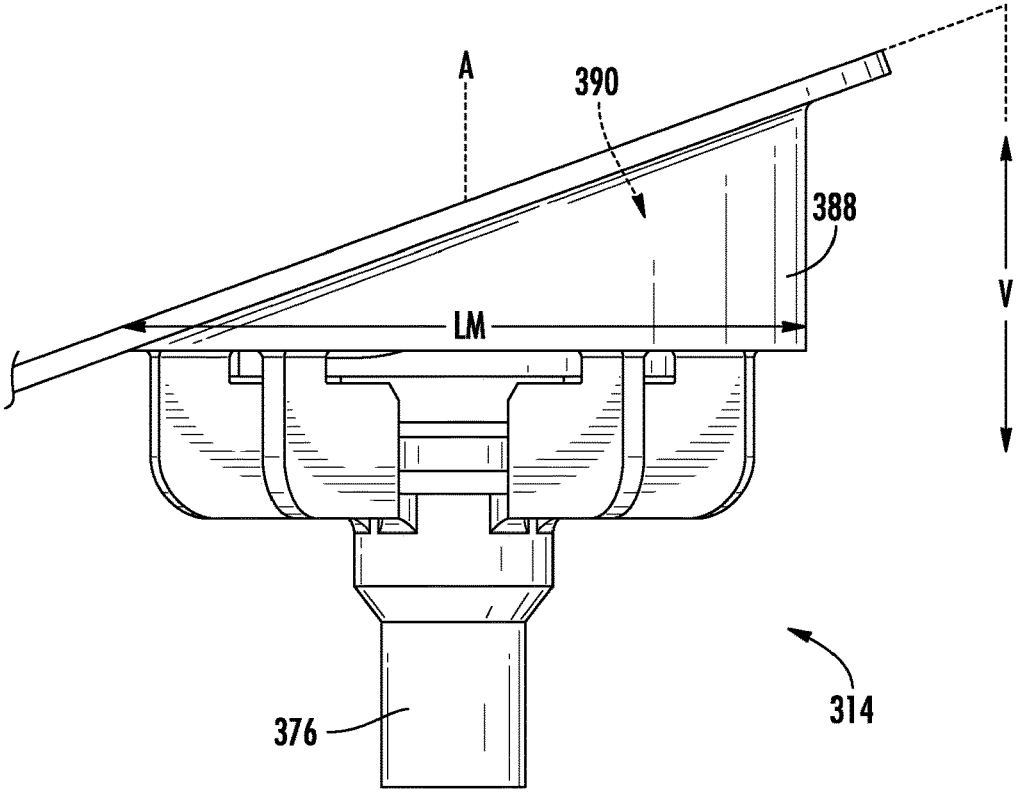
FIG. 9 provides an elevation view of a portion of a water dispensing assembly of the exemplary ice-making assembly of FIG. 1.
Figure 10:
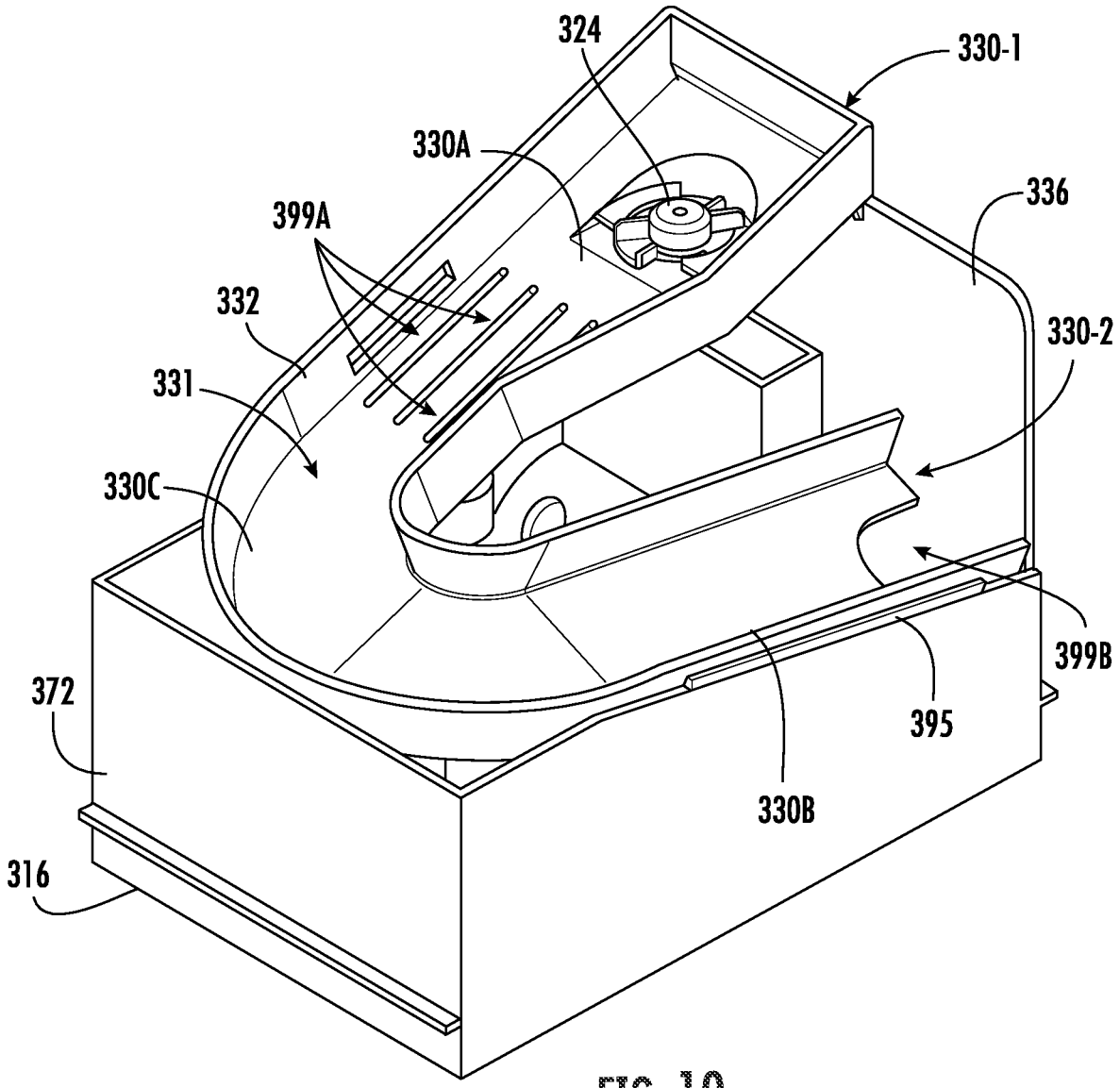
FIG. 10 provides a perspective view of a portion of the exemplary ice-making assembly of FIG. 1, including a guide ramp and a water basin.
Figure 11A:
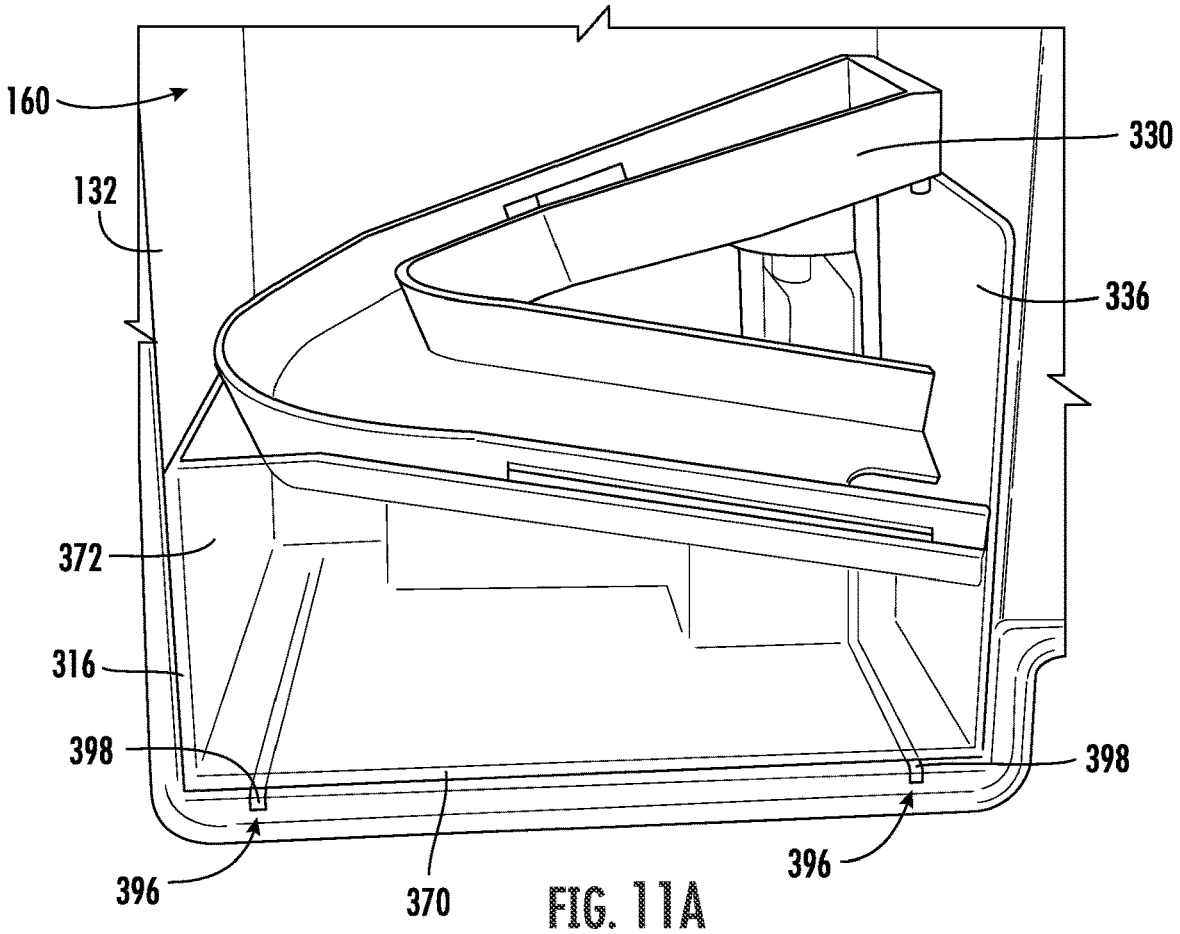
FIG. 11A provides a front perspective view of a portion of the exemplary ice-making assembly of FIG. 1, including the guide ramp and the water basin.
Figure 11B:
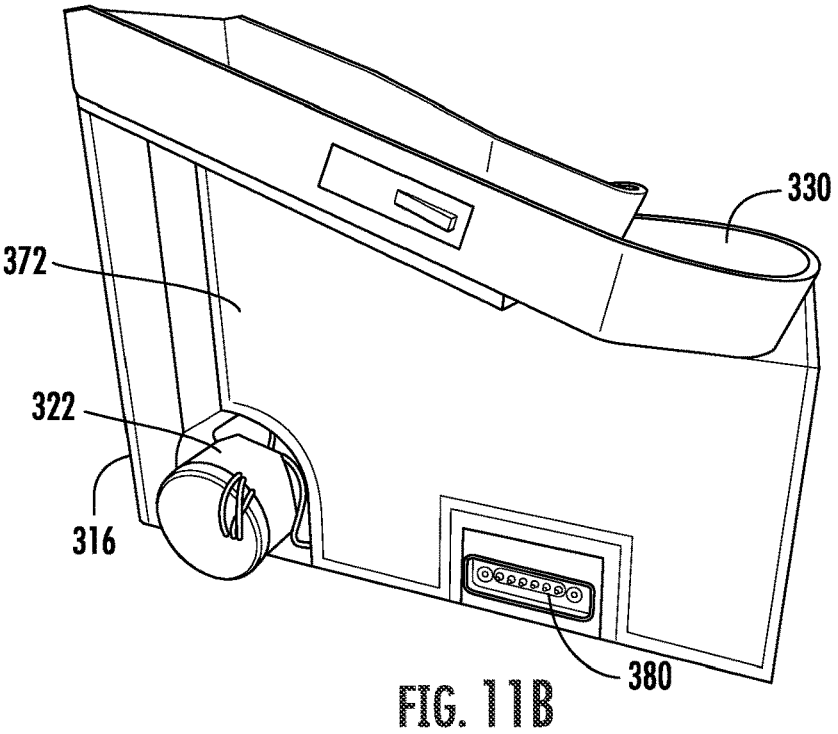
FIG. 11B provides a rear perspective view of a portion of the exemplary ice-making assembly of FIG. 1, including the guide ramp and the water basin.
Figure 12:
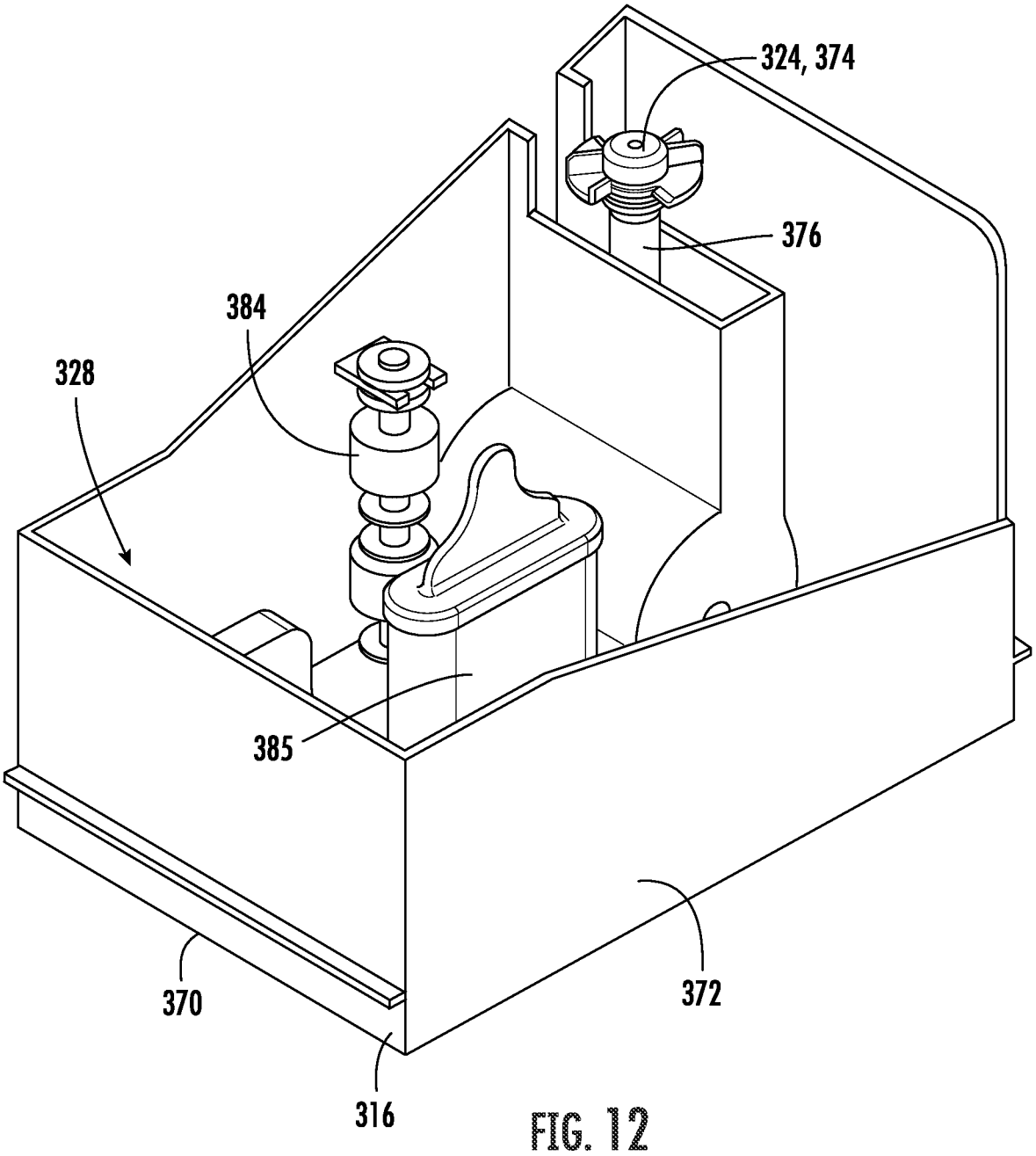
FIG. 12 provides another perspective view of a portion of the exemplary ice-making assembly of FIG. 1, including the water basin.
Figure 13:
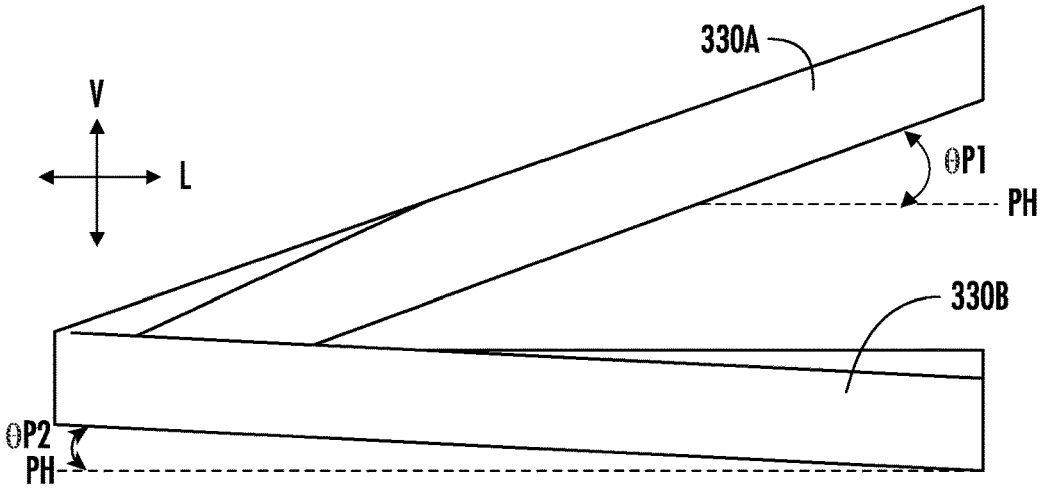
FIG. 13 provides a front schematic elevation view of the guide ramp of the exemplary ice-making assembly of FIG. 1.
Figure 14:
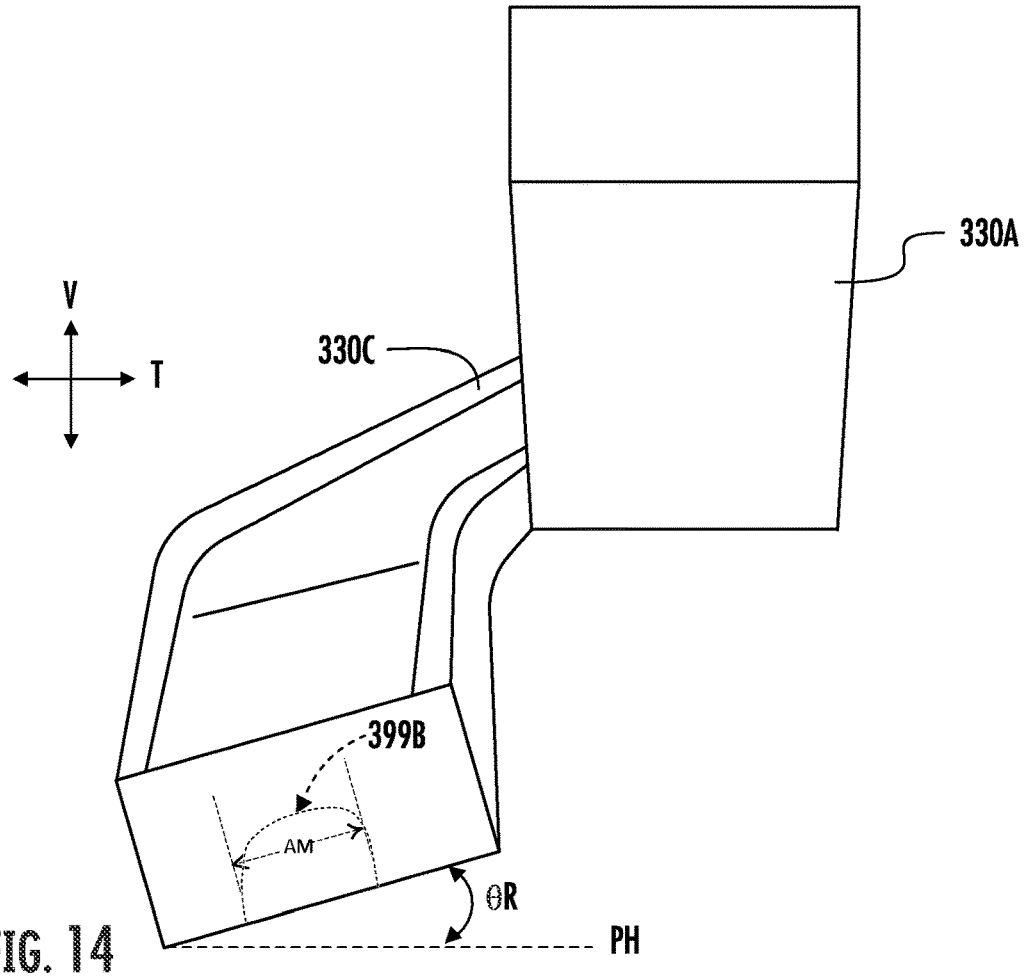
FIG. 14 provides a side schematic elevation view of the guide ramp of the exemplary ice-making assembly of FIG. 1.
Figure 15:
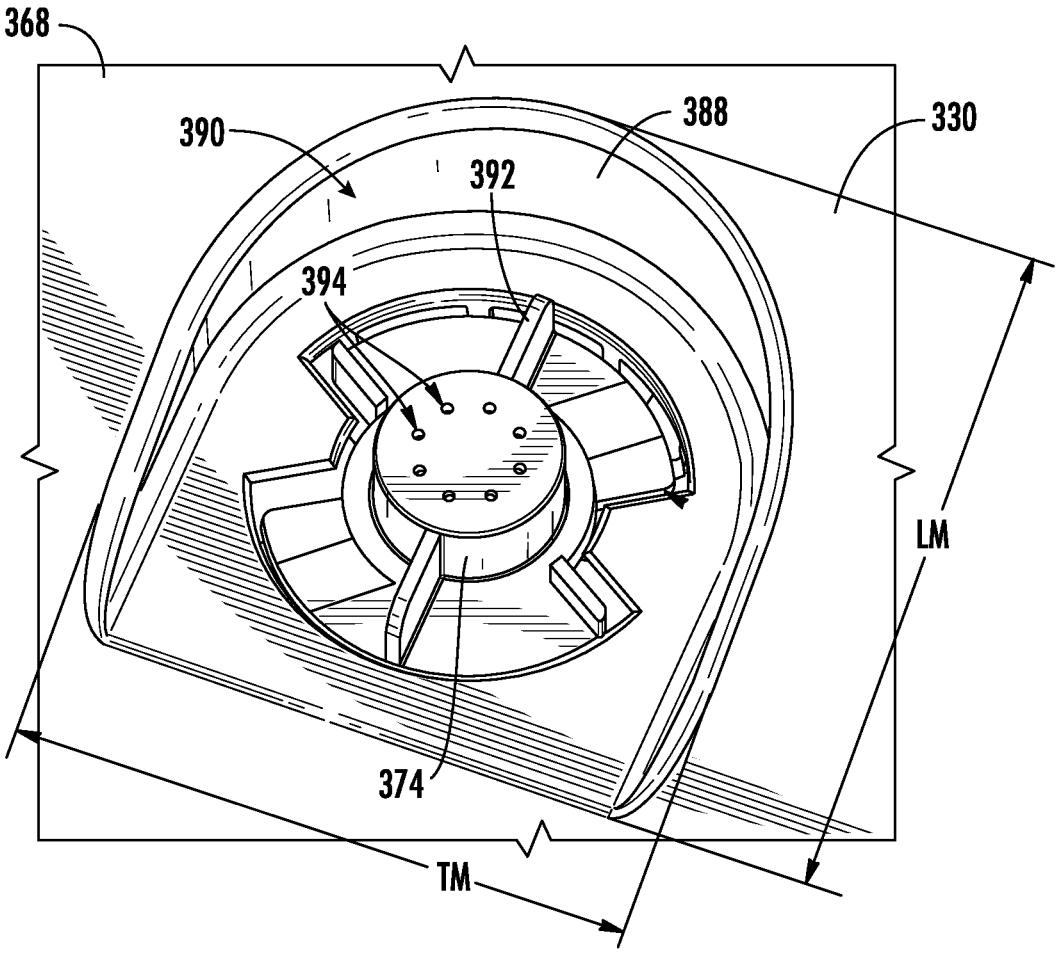
FIG. 15 provides a perspective view of a spray cap according to exemplary embodiments of the present disclosure.
Figure 16:
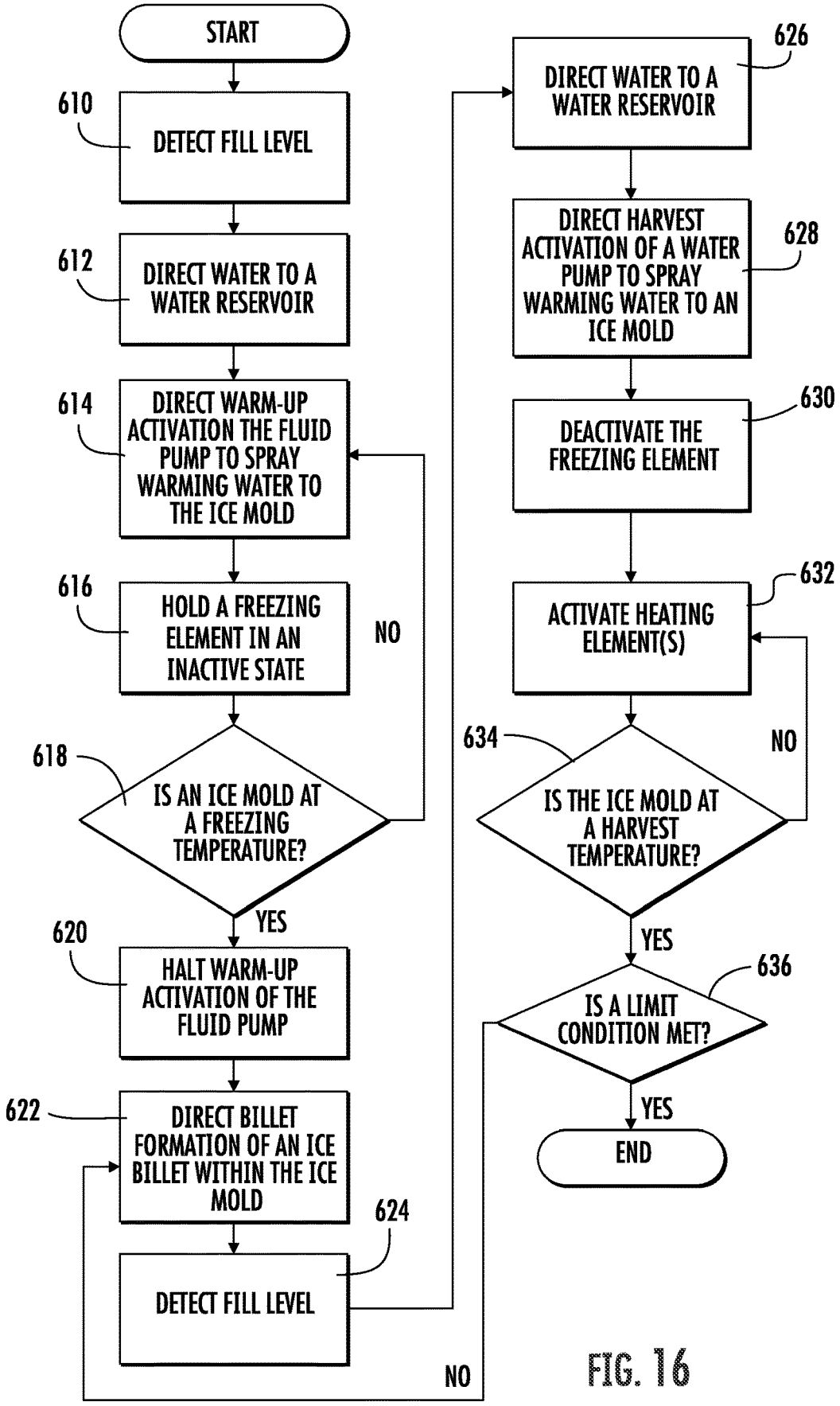
FIG. 16 provides a flow chart illustrating a method of operating an ice-making assembly of a refrigerator appliance according to exemplary embodiments of the present disclosure.

Turning now to FIG. 16, a flow chart is provided of a method 600 according to exemplary embodiments of the present disclosure. Generally, FIG. 5 provides a method of operating a refrigerator appliance 100 (FIG. 1) or ice-making assembly 300 (FIG. 4) that includes a water dispenser 312 and mold assembly 310, as described above. The method 600 can be performed, for instance, by the controller 194. For example, controller 194 may, as discussed, be in operable (e.g., electrical or wireless) communication with fluid pump 322, liquid level sensor 384, freezing element 325(*s*). During operations, controller 194 may send signals to and receive signals from fluid pump 322, liquid level sensor 384, temperature sensor 360, fan 192, TEHE 348, heating element(s) 349, limiting switch 386, etc. Controller 194 may further be operatively coupled to other suitable components of the appliance 100 to facilitate operation of the appliance 100 generally.

Advantageously, methods in accordance with the present disclosure may facilitate the consistent or reliable formation of clear ice billets and prevent clouding or disfigurement of the ice billets withing a refrigerator appliance. Additionally or alternatively, methods herein may advantageously accelerate clear ice formation (e.g., in comparison to existing methods).

FIG. 16 depicts steps performed in a particular order for purpose of illustration and discussion. Those of ordinary skill in the art, using the disclosures provided herein, will understand that the steps of any of the methods disclosed herein can be modified, adapted, rearranged, omitted, or expanded in various ways without deviating from the scope of the present disclosure (except as otherwise described).

At 610, the method 600 includes, detecting a fill level (e.g., at the liquid level sensor). For instance, while the conductive ice mold or mold cavity is free of any ice or water therein (e.g., prior to 614), the fill level within the water reservoir may be generally detected. In some embodiments, one or more signals may be received from the liquid level sensor indicating a water level below a set threshold within the water basin. In other words, there may be less water than the set threshold within the water reservoir, as described above.

At 612, the method 600 includes directing water (e.g., from the water source) to the water reservoir of the water basin. The water directed to the water reservoir may be relatively warm water flowed from the water source to the IB compartment (e.g., as described above and as would generally be understood). In some embodiments 612 is in response to 610. In additional or alternative embodiments, 612 is performed while the conductive ice mold or mold cavity is free of any ice or water therein (e.g., prior to 614).

At 614, the method 600 includes directing warm-up activation the fluid pump to spray warming water to the ice mold (i.e., toward the mold cavity) while the mold cavity is generally empty. Specifically, the fluid pump may be activated to spray warming water to the conductive ice mold from the water dispenser (e.g., water from or within the water basin), as described above. As relatively warm water (e.g., in comparison to the ice mold), the spray at 614 may remove accumulated frost or otherwise preheat the ice mold.

At 616, the method 600 includes holding one or more freezing elements in an inactive state. Specifically, the freezing elements may be held inactive while 614 is performed (e.g., for the duration of the spray of warming water). As noted above, the freezing elements may include a fan configured to direct air along an air path through the IB compartment. Thus, the fan may be prevented from rotating, limiting heat transfer and preventing the formation of ice within the mold cavity. As also noted above, the freezing elements may include a TEHE in conductive thermal communication with the ice mold. Thus, the TEHE may be prevented from generating a heat differential to draw heat away from the mold cavity, limiting heat transfer and preventing the formation of ice within the mold cavity.

At 618, the method 600 includes evaluating the temperature at the ice mold (e.g., during 614 or while directing warm-up activation). For instance, an evaluation may be made (e.g., based on one or more temperature signals from the temperature sensor) as to whether the ice mold is either above or, alternatively, at or below a preparation target temperature, such as freezing (e.g., 0° Celsius). If at or below freezing, the method 600 may return to or continue 614. If above freezing, the method 600 may be understood detect the preparation target temperature and proceed to 620.

At 620, the method 600 includes halting warm-up activation of the fluid pump. In other words, the warming water spray of 614 may be stopped (e.g., in response to detecting the preparation target temperature at 618.

At 622, the method 600 directing billet formation of an ice billet within the ice mold (e.g., as described above). In some embodiments, 622 includes directing ice-building activation of the fluid pump to spray ice-building water to the conductive ice mold from the water dispenser (e.g., water from or within the water basin). Moreover, as the ice-building spray is being pumped, one or more of the freezing elements may be directed to activate in a cooling state. As an example, the fan may be directed to motivate air along the air path and draw heat from the mold cavity (e.g., as described above). As an additional or alternative example, the TEHE may be directed to a freezing mode in which heat is conductive through the TEHE and away from the mold cavity (e.g., as described above).

Following formation of the billet, which may be indicated by expiration of a set timer or one or more detected conditions (e.g., as would be understood), the fluid pump may be directed to the inactive state such that water is no longer sprayed to the mold cavity (e.g., the formed ice billet therein).

At 624, the method 600 includes detecting a fill level (e.g., at the liquid level sensor). In some embodiments, 624 follows 622 and, thus, corresponds to the amount of water within the water reservoir following billet formation. For instance, while an ice billet is held within the conductive ice mold or mold cavity (e.g., prior to 628), the fill level within the water reservoir may be generally detected. In some embodiments, one or more signals may be received from the liquid level sensor indicating a water level below a set threshold within the water basin. In other words, there may be less water than the set threshold within the water reservoir, as described above.

At 626, the method 600 includes directing water (e.g., from the water source) to the water reservoir of the water basin. The water directed to the water reservoir may be relatively warm water flowed from the water source to the IB compartment (e.g., as described above and as would generally be understood). In some embodiments 626 is in response to 624. In additional or alternative embodiments, 626 is performed an ice billet is held within the conductive ice mold or mold cavity (e.g., prior to 628).

At 628, the method 600 includes directing harvest activation the fluid pump to spray warming water to the ice mold (i.e., toward the mold cavity) while the mold cavity hold an ice billet (e.g., following or in response to detected completion of 622, 624, or 626). Specifically, the fluid pump may be activated to spray warming water to the conductive ice mold from the water dispenser (e.g., water from or within the water basin), as described above. As relatively warm water (e.g., in comparison to the ice mold), the spray at 628 may remove or melt at least a portion of the ice billet or accumulated portions of ice along the edges or outer surface of ice mold. Additionally or alternatively, the falling of melted water to the water basin may chill water within the water reservoir. Optionally, 628 may continue for a set harvesting period.

At 630, the method 600 includes deactivating one or more freezing elements. For instance, the fan or TEHE may be turned off or otherwise directed to stop cooling or drawing heat from the mold cavity (e.g., following or in response to 622). Moreover, once deactivated, such freezing elements may be held in an inactive state. Optionally, 630 may follow or be in response to 628.

At 632, the method 600 includes activating one or more heating element(s). For instance, as described above, one or more electrical heating elements may be activated to generate heat within the ice mold or mold cavity. Additionally or alternatively, the TEHE may be directed to a heating mode to heat the mold cavity and at least partially melt or release the ice billet therefrom. Optionally, 632 may follow or be in response to 628.

At 634, the method 600 includes evaluating the temperature at the ice mold (e.g., during 630 or while directing activation of the heating element(s)). For instance, an evaluation may be made (e.g., based on one or more temperature signals from the temperature sensor) as to whether the ice mold is either above or, alternatively, at or below a harvest target temperature, such as an above freezing temperature (e.g., 4° Celsius). If below the harvest target temperature, the method 600 may return to or continue 630. If at or above the harvest target temperature, the method 600 may be understood have released the ice billet and proceed to 636.

At 636, the method 600 includes evaluating a limit condition. The limit condition may be based on, for instance, one or more signals received from a limiting switch, as described above. In some embodiments, one or more signals from the limiting switch are understood to indicate the presence of a predetermined number or volume of ice billets (e.g., at a predetermined location on the guide ramp). If no such indication is determined or received, the method may return to one or more earlier steps (e.g., 610 or 614) and generate a new ice billet. If such an indication is determined, however, the generation of new ice billets, or the operation generally, may be ceased (e.g., until the limit condition is no longer met).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet;

a liner attached to the cabinet, the liner defining an icebox (IB) compartment;

a conductive ice mold mounted within the IB compartment, the conductive ice mold defining a mold cavity;

a water dispenser positioned below the conductive ice mold to direct an ice-building spray of water to the mold cavity; and a water basin removably disposed within the IB compartment below the conductive ice mold, the water basin comprising a basin wall defining a water reservoir and an electrical basin plug fixed to the basin wall to move therewith.

2. The refrigerator appliance of claim 1, wherein the basin wall comprises a vertical sidewall, and wherein the electrical basin plug is fixed to the vertical sidewall.

3. The refrigerator appliance of claim 1, further comprising an electrical stationary plug fixed to the liner in selective contact with the electrical basin plug.

4. The refrigerator appliance of claim 1, further comprising a fluid pump attached to the water basin in fluid communication with the water dispenser to motivate water from the water reservoir to the water dispenser, the fluid pump being in electrical communication with the electrical basin plug.

5. The refrigerator appliance of claim 1, further comprising a liquid level sensor attached to the water basin and configured to detect a water level within the water reservoir, the liquid level sensor being in electrical communication with the electrical basin plug.

6. The refrigerator appliance of claim 1, wherein the water dispenser comprises a guide ramp supported on the water basin above the water reservoir and below the conductive ice mold to receive an ice billet therefrom.

7. The refrigerator appliance of claim 6, wherein the guide ramp comprises an upper segment and a lower segment, the lower segment extending along an angle less than the upper segment relative to a horizontal direction to hold an ice billet, and wherein the water dispenser further comprises a spray cap defining an outlet aperture on the upper segment.

8. The refrigerator appliance of claim 6, wherein the guide ramp defines a plurality of drain slots above the water reservoir to permit water thereto.

9. The refrigerator appliance of claim 1, wherein the liner further defines one or more horizontal grooves below the conductive ice mold, and wherein the water basin further comprises one or more horizontal rail slidably received within the one or more horizontal grooves.

10. The refrigerator appliance of claim 1, further comprising an air conduit disposed within the IB compartment, the air conduit defining a conduit path between a conduit inlet and a conduit outlet as part of the conduit path.

11. The refrigerator appliance of claim 10, further comprising a heat exchange (HE) sleeve disposed along the air conduit between the conduit inlet and the conduit outlet to release heat to air within the conduit path, wherein the conductive ice mold is mounted to the HE sleeve within the IB compartment to conduct heat to the HE sleeve.

12. A refrigerator appliance comprising:

a cabinet;

a liner attached to the cabinet, the liner defining an icebox (IB) compartment;

a thermodynamic assembly mounted within the cabinet outside of the IB compartment, the thermodynamic assembly comprising a chilled air supply duct and a chilled air return duct defining at least a portion of an air path to circulate a chilled airflow;

a conductive ice mold mounted within the IB compartment, the conductive ice mold defining a mold cavity along the air path to receive the chilled airflow from the chilled air supply duct;

a water dispenser positioned below the conductive ice mold to direct an ice-building spray of water to the mold cavity; and a water basin slidably disposed within the IB compartment below the conductive ice mold, the water basin comprising a basin wall defining a water reservoir and an electrical basin plug fixed to the basin wall to move therewith.

13. The refrigerator appliance of claim 12, wherein the basin wall comprises a vertical sidewall, and wherein the electrical basin plug is fixed to the vertical sidewall.

14. The refrigerator appliance of claim 12, further comprising an electrical stationary plug fixed to the liner in selective contact with the electrical basin plug.

15. The refrigerator appliance of claim 12, further comprising a fluid pump attached to the water basin in fluid communication with the water dispenser to motivate water from the water reservoir to the water dispenser, the fluid pump being in electrical communication with the electrical basin plug.

16. The refrigerator appliance of claim 12, further comprising a liquid level sensor attached to the water basin and configured to detect a water level within the water reservoir, the liquid level sensor being in electrical communication with the electrical basin plug.

17. The refrigerator appliance of claim 12, wherein the water dispenser comprises a guide ramp supported on the water basin above the water reservoir and below the conductive ice mold to receive an ice billet therefrom.

18. The refrigerator appliance of claim 17, wherein the guide ramp comprises an upper segment and a lower segment, the lower segment extending along an angle less than the upper segment relative to a horizontal direction to hold an ice billet, and wherein the water dispenser further comprises a spray cap defining an outlet aperture on the upper segment.

19. The refrigerator appliance of claim 17, wherein the guide ramp defines a plurality of drain slots above the water reservoir to permit water thereto.

20. The refrigerator appliance of claim 12, wherein the liner further defines one or more horizontal grooves below the conductive ice mold, and wherein the water basin further comprises one or more horizontal rail slidably received within the one or more horizontal grooves.

* * * * *